US011761223B2

(12) United States Patent
Crookham et al.

(10) Patent No.: US 11,761,223 B2
(45) Date of Patent: Sep. 19, 2023

(54) APPARATUS AND METHOD FOR DESIGN AND INSTALLATION OF A CUSTOMIZABLE SOCCER MINI-PITCH SYSTEM

(71) Applicant: Musco Corporation, Oskaloosa, IA (US)

(72) Inventors: Joe P. Crookham, Oskaloosa, IA (US); Jeffrey A. Rogers, Oskaloosa, IA (US); Timothy J. Boyle, Oskaloosa, IA (US); Nathan E. Herz, Lovilla, IA (US)

( * ) Notice: Subject to any disclaimer, the term of this patent is extended or adjusted under 35 U.S.C. 154(b) by 199 days.

(21) Appl. No.: 17/248,215

(22) Filed: Jan. 14, 2021

(65) Prior Publication Data

US 2021/0131129 A1 May 6, 2021

Related U.S. Application Data

(63) Continuation of application No. 16/519,947, filed on Jul. 23, 2019, now Pat. No. 10,920,437.
(Continued)

(51) Int. Cl.
*E04H 3/14* (2006.01)
*A63B 63/00* (2006.01)
(Continued)

(52) U.S. Cl.
CPC ..... *E04H 3/14* (2013.01); *A63B 63/004* (2013.01); *A63B 2209/00* (2013.01); *E01C 13/083* (2013.01); *E01C 2013/006* (2013.01)

(58) Field of Classification Search
CPC .... E04H 3/00; E04H 3/10; E04H 3/14; A63C 19/00; A63C 19/06; A63C 19/08; E04F 15/02183
(Continued)

(56) References Cited

U.S. PATENT DOCUMENTS 1,383,234 A 6/1921 Raguse
2,278,287 A 3/1942 Ryan
(Continued)

FOREIGN PATENT DOCUMENTS

CN 1736523 A 2/2006
CN 206904518 U 1/2018
(Continued)

OTHER PUBLICATIONS

Musco Corporation, in connection with PCT/US2019/042957 filed Jul. 23, 2019, "The International Search Report and the Written Opinion of the International Searching Authority, or the Declatation", 12 pages, dated Nov. 8, 2019.
(Continued)

*Primary Examiner* — Kien T Nguyen
(74) *Attorney, Agent, or Firm* — Kurt J. Fugman; Mark D. Hansing

(57) ABSTRACT

There exists a number of youth development programs centered on sports programming. Some of these programs operate on a platform of revitalizing neighborhood spaces to improve community engagement by creating a space for youth to enjoy sports. Oftentimes these neighborhood spaces include restrictions or the surrounding community has needs (like lighting and seating) which are unmet or under-met. Envisioned is a system approach to addressing these needs wherein a wide variety of custom solutions can be produced from prefabricated, modular, and portable components that interface with existing amenities (if any) so to enrich the youth experience and better achieve program objectives. This modular approach provides a common infrastructure for different spaces, different sports, and different levels of play.

16 Claims, 33 Drawing Sheets

Related U.S. Application Data

Figure 1A:
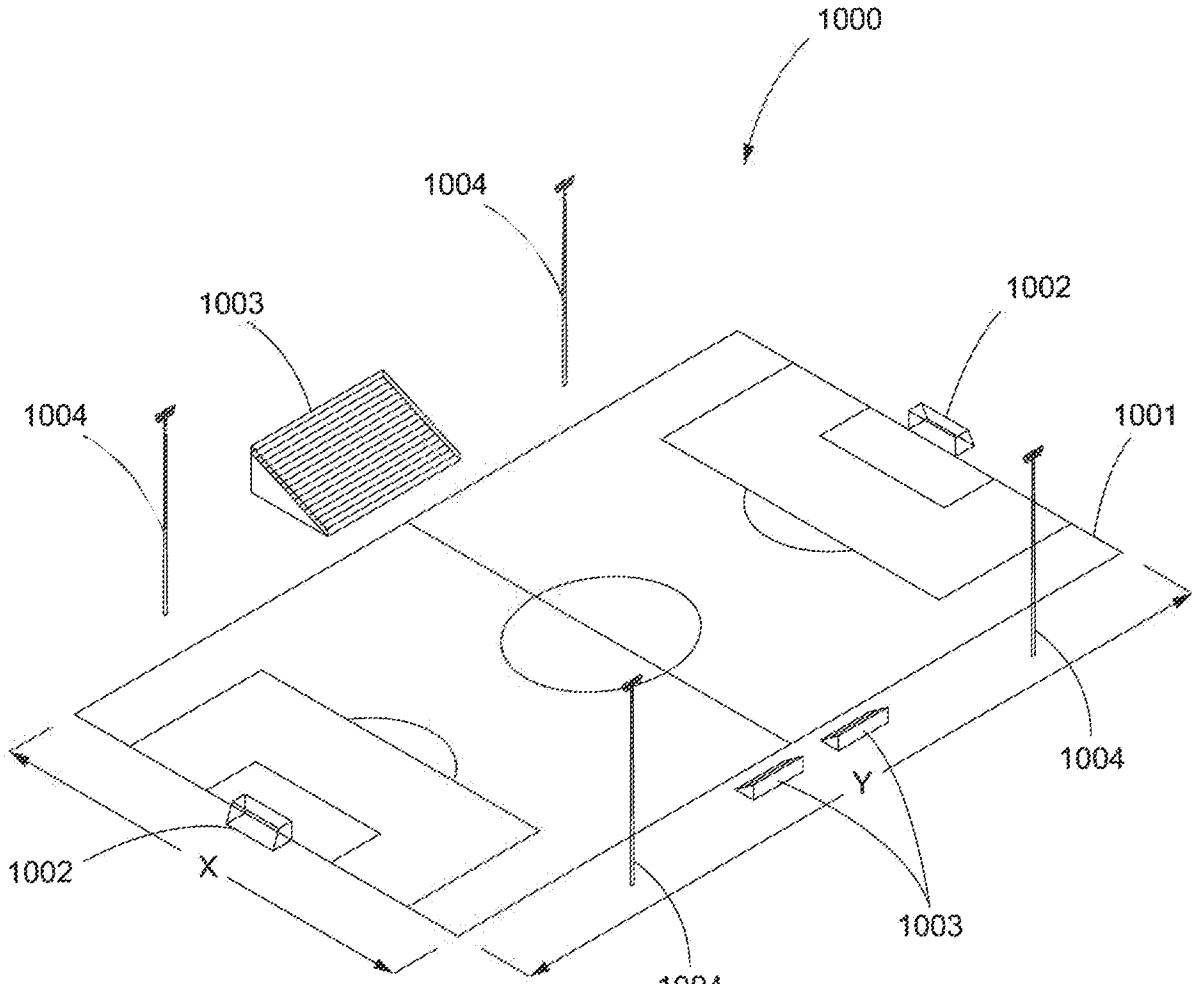

(60) Provisional application No. 62/703,468, filed on Jul. 26, 2018.

(51) Int. Cl.
*E01C 13/00* (2006.01)
*E01C 13/08* (2006.01)

(58) Field of Classification Search
USPC ..... 472/88–94; 52/6, 8, 86, 588
See application file for complete search history.

(56) References Cited

U.S. PATENT DOCUMENTS

| | | | | |
|---|---|---|---|---|
| 2,726,866 | A * | 12/1955 | Nally | E04H 3/28 52/646 |
| 2,985,261 | A | 5/1961 | Kubesh | |
| 2,998,106 | A | 8/1961 | Aust | |
| 3,270,480 | A | 9/1966 | Beecker | |
| 3,452,837 | A | 7/1969 | Herrell et al. | |
| 4,070,805 | A * | 1/1978 | Kastner | E04H 3/14 52/270 |
| 4,107,770 | A | 8/1978 | Weber | |
| 4,228,489 | A | 10/1980 | Martin | |
| 4,617,768 | A | 10/1986 | Gebelius | |
| 5,103,600 | A | 4/1992 | Geiger et al. | |
| 5,255,322 | A | 10/1993 | Farinelli et al. | |
| 5,312,109 | A | 5/1994 | Cagle | |
| 5,622,021 | A * | 4/1997 | Bookout | E04H 3/14 52/745.1 |
| 5,738,588 | A | 4/1998 | Esser | |
| 5,820,470 | A | 10/1998 | Saunders | |
| 5,938,546 | A | 8/1999 | Caruso | |
| 5,961,403 | A | 10/1999 | Caruso | |
| 6,004,218 | A | 12/1999 | Keating et al. | |
| 6,261,196 | B1 | 7/2001 | Caruso | |
| 6,287,220 | B1 | 9/2001 | Caruso | |
| 6,308,468 | B1 | 10/2001 | Caruso | |
| 6,394,918 | B1 | 5/2002 | Erhard | |
| 7,241,235 | B2 | 7/2007 | Caruso | |
| 7,300,059 | B2 | 11/2007 | Caruso | |
| 7,341,531 | B2 | 3/2008 | Caruso | |
| 7,736,247 | B2 | 6/2010 | Caruso | |
| 7,828,678 | B1 | 11/2010 | Caruso | |
| 8,063,936 | B2 | 11/2011 | Samarasekera et al. | |
| 8,272,769 | B2 | 9/2012 | Bassani | |
| 8,434,902 | B2 | 5/2013 | Velazquez | |
| 9,017,179 | B1 | 4/2015 | Moody | |
| 2009/0021058 | A1* | 1/2009 | Rajack | A47C 7/68 297/188.18 |
| 2018/0020651 | A1* | 1/2018 | Larkin | B60R 7/08 43/21.2 |

FOREIGN PATENT DOCUMENTS

| | | | |
|---|---|---|---|
| CN | 207520581 | U | 6/2018 |
| EP | 2166277 | A1 | 3/2010 |
| JP | 2012120598 | A | 6/2012 |
| KR | 970070386 | A | 11/1997 |
| KR | 1019970070386 | | 11/1997 |
| KR | 200367705 | Y1 | 11/2004 |
| KR | 101278537 | B1 | 6/2013 |

OTHER PUBLICATIONS

Machine Translation in English of "Office Action" issued in connection to Application No. 201980049781.4, 11 pages, accessed Jul. 14, 2021.
China National Intellectual Property Administration, "Office Action", issued in connection to Application No. 201980049781.4, 11 pages, dated Jul. 14, 2021.
Machine Translation in English of CN 1736523A.
Machine Translation in English of CN 207520581U.
Machine Translation in English of KR 970070386A.
Machine Translation in English of CN 206904518U.

* cited by examiner

Detail A

Detail B

Detail C

Detail E

To Detail E

Detail F

Detail G

Detail H

Center Field - Left Side View

Center Field - Right Side View

Center Field - Top Side View

Detail I

APPARATUS AND METHOD FOR DESIGN AND INSTALLATION OF A CUSTOMIZABLE SOCCER MINI-PITCH SYSTEM

CROSS-REFERENCE TO RELATED APPLICATION

This is a continuation application of U.S. Ser. No. 16/519,947, filed Jul. 23, 2019, which claims priority under 35 U.S.C. § 119 to provisional application Ser. No. 62/703,468 filed Jul. 26, 2018, both of which are herein incorporated by reference in their entireties.

I. TECHNICAL FIELD OF INVENTION

The present invention generally relates to prefabricated, modular, and portable soccer mini-pitch systems customized for neighborhood spaces. More specifically, the present invention relates to providing infrastructure, seating, lighting, storage, and other features (in addition to playing surface and goals) to supplement and enrich youth development programs—such as the SOCCER FOR SUCCESS® program offered by the US Soccer Foundation—and provide greater accessibility to soccer in areas where traditional pitch development is not feasible.

II. BACKGROUND OF THE INVENTION

The SOCCER FOR SUCCESS® program and others like it (domestic and international) are often built on platforms of providing safe environments and physical activities for youth. Such programs often focus on communities having old basketball courts, parking lots, or other neighborhood spaces which can be repurposed to provide much needed sports programming and community engagement. Space is almost always limited (even in cases where an urban space is specifically developed), so for the sport of soccer mini-pitches are installed instead of full pitches. Depending on available space mini-pitches can range from around 40'×84' to up to 60'×120'; goal size, goal depth, and penalty area (if any) may likewise vary. Each community is different in its needs, and each neighborhood space is different in its restrictions (e.g., size, layout, amenities), which means each solution is unique—which presents challenges.

Using a soccer-based youth development program as an example, it can be appreciated that any such program likely has well structured funding models, turnkey solutions for goal/field line layout, and established techniques for laying the play surface; but it can also be appreciated that more can be done to add value by providing solutions for unmet or under-met needs. For example, many existing neighborhood spaces such as old basketball courts do not have lighting (which limits hours of operation); many do not have adequate seating (which limits community engagement); and many have no provisions to keep balls on the pitch and out of nearby residences or traffic (which can be a safety concern). The aforementioned objectives of providing safe environments and physical activities for youth could be better met by providing any of the aforementioned, but there is simply no easy way of doing so given the lack of a common infrastructure for the many combinations of needs and restrictions.

What is needed in the above example is a solution that is as varied as the needs of the program itself—where lighting, seating, safety, portability, and the like can all be addressed at a system level, and in a manner that also rolls in features such as goal/field line layouts and play surface already well addressed within the program. No such system approach to designing and installing soccer mini-pitches for youth development programs (or otherwise) is known, and thus, there is room for improvement in the art.

III. SUMMARY OF THE INVENTION

Programs such as the SOCCER FOR SUCCESS® youth development program offer unique solutions for communities with various needs and neighborhood spaces with various restrictions to provide safe environments and physical activities for youth. The focus of such programs is often on play itself—giving priority to goals and playing surface when funds are limited (which they often are)—leaving such things as seating and lighting unaddressed or under-addressed. Even if funding allows, in the current state of the art there is no well-defined approach to addressing said needs—no infrastructure which could accommodate seating and lighting and interface with goals, yet be customizable to produce each unique solution. Additionally, many of these neighborhood spaces cannot accommodate large commercial vehicles, and so it is unclear how any such infrastructure (even if designed) could be transported and installed. Ultimately, it is clear that value can be added to said youth development programs by adding features such as seating and lighting, but the state of the art is lacking in means to do so.

It is therefore a principle object, feature, advantage, or aspect of the present invention to improve over the state of the art and/or address problems, issues, or deficiencies in the art.

Envisioned is a soccer mini-pitch system; namely, a system approach to providing play surface, goals, seating, lighting, storage, and other features via a number of prefabricated components. Said components can be combined in different quantities to create unique solutions that address the various needs of communities and restrictions of neighborhood spaces. Said components are of rugged construction to withstand outdoor use, of a modular nature and otherwise sized for compact packing and delivery on standard flatbed trucks (e.g., an over-the-road semi/tractor with trailer) or standard shipping containers, and because they can be mass produced and a large number of solutions created from a relatively small number of components, are cost effective.

Further objects, features, advantages, or aspects of the present invention may include one or more of the following:

a. solutions for both single and double pitch layouts, including for a variety of field sizes;
b. non-bolted and bolted solutions to address anticipated wind loads;
c. lighting, and power means for said lighting where there are none in a neighborhood space;
d. seating, and beverage or temporary storage proximate said seating;
e. additional and/or secure storage (e.g., for balls);
f. solutions for keeping a ball on the pitch during play; and
g. solutions for pitch maintenance.

These and other objects, features, advantages, or aspects of the present invention will become more apparent with reference to the accompanying specification and claims.

IV. BRIEF DESCRIPTION OF THE DRAWINGS

From time-to-time in this description reference will be taken to the drawings which are identified by figure number and are summarized below.

Figure 1B:
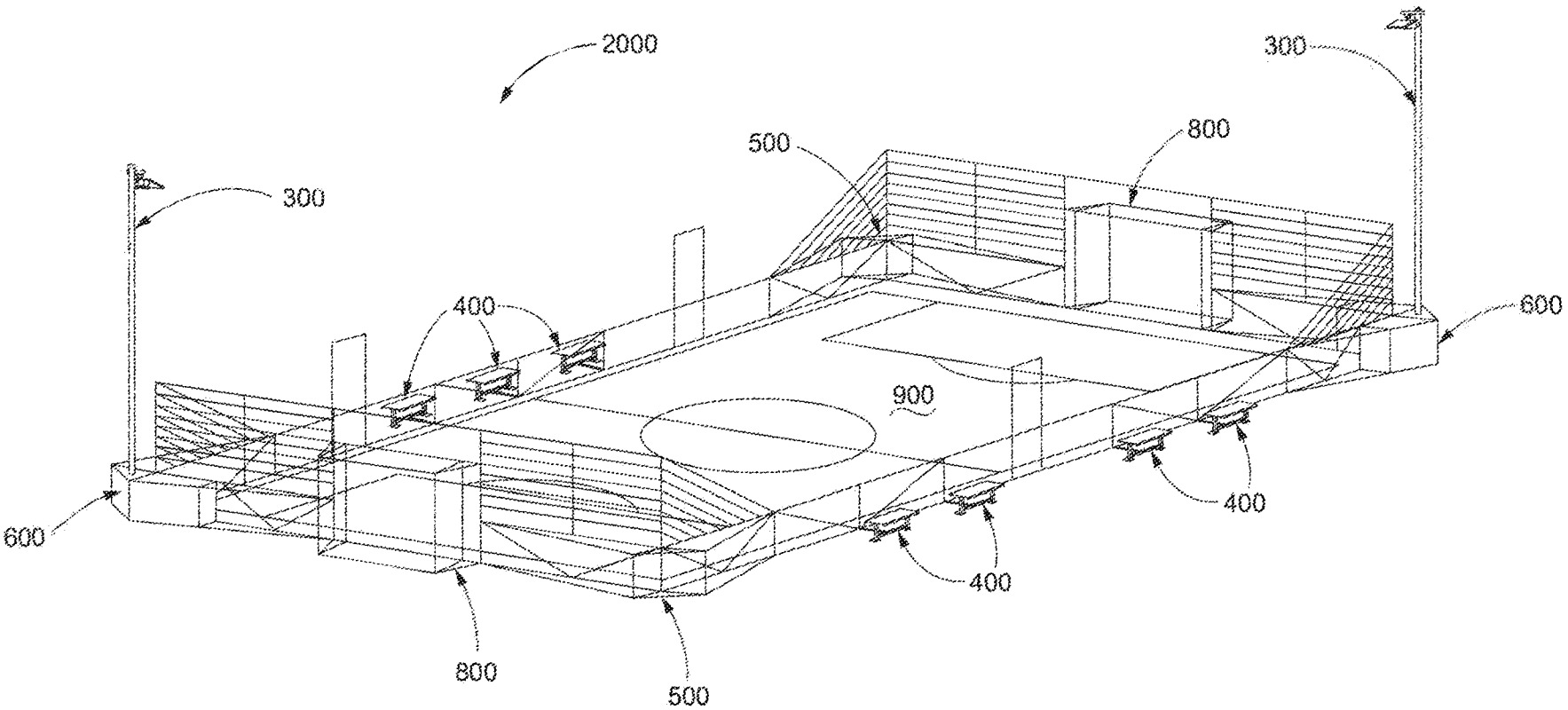

FIG. 1A illustrates a perspective view of a typical standard size soccer venue. FIG. 1B illustrates generically a perspective view of a soccer mini-pitch system designed according to aspects of the present invention.

Figure 2A:
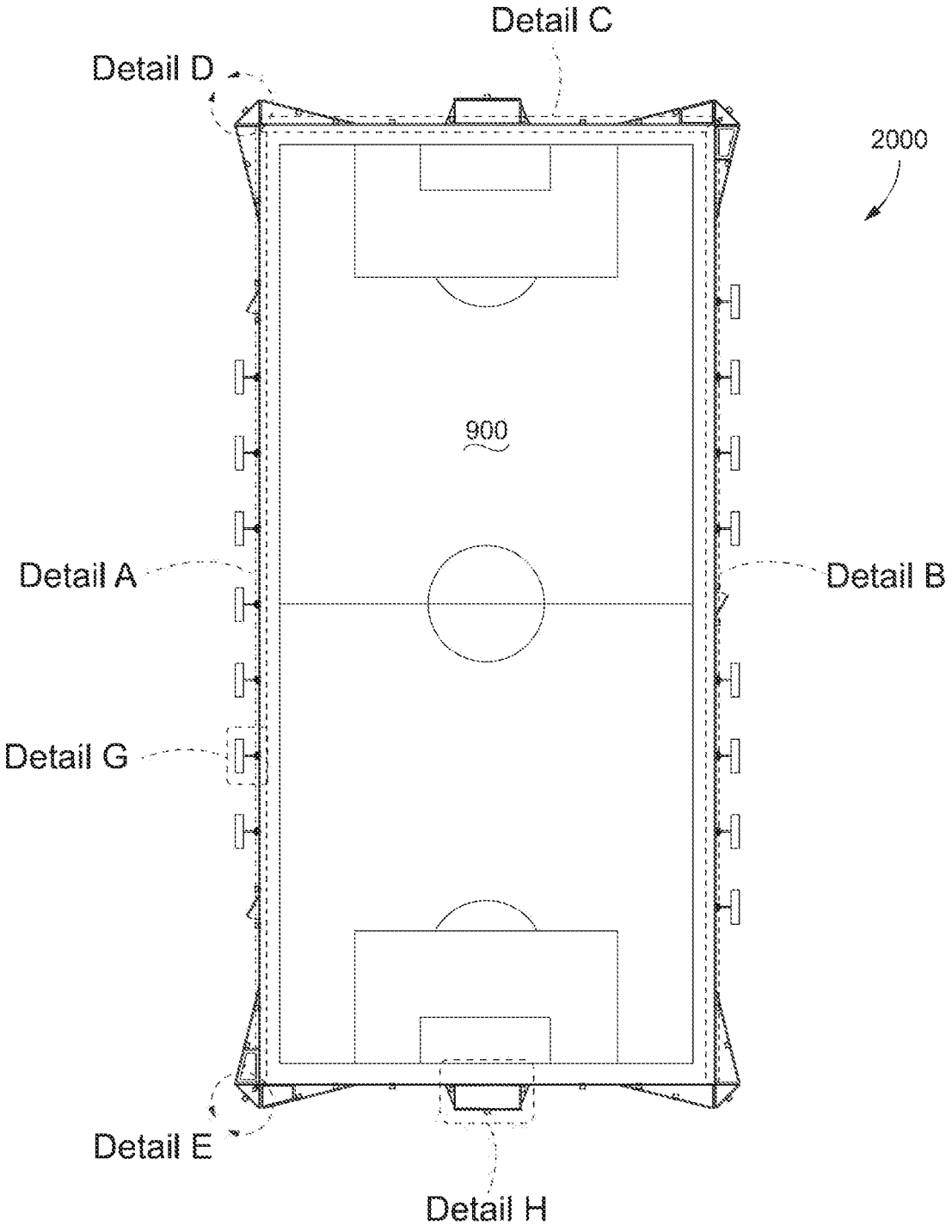
Figure 2B:
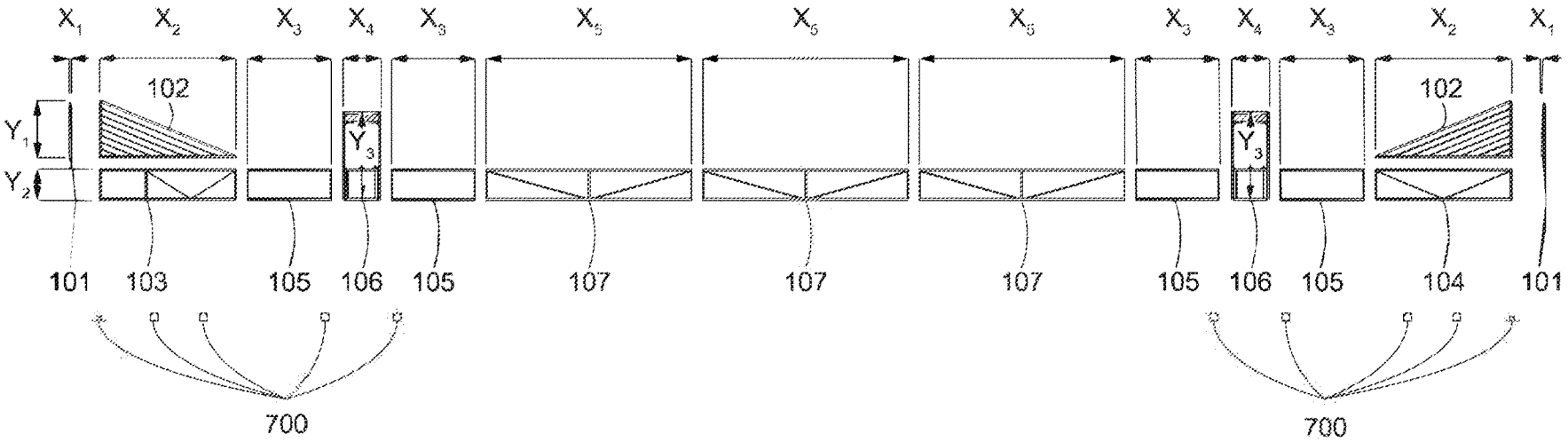
Figure 2C:
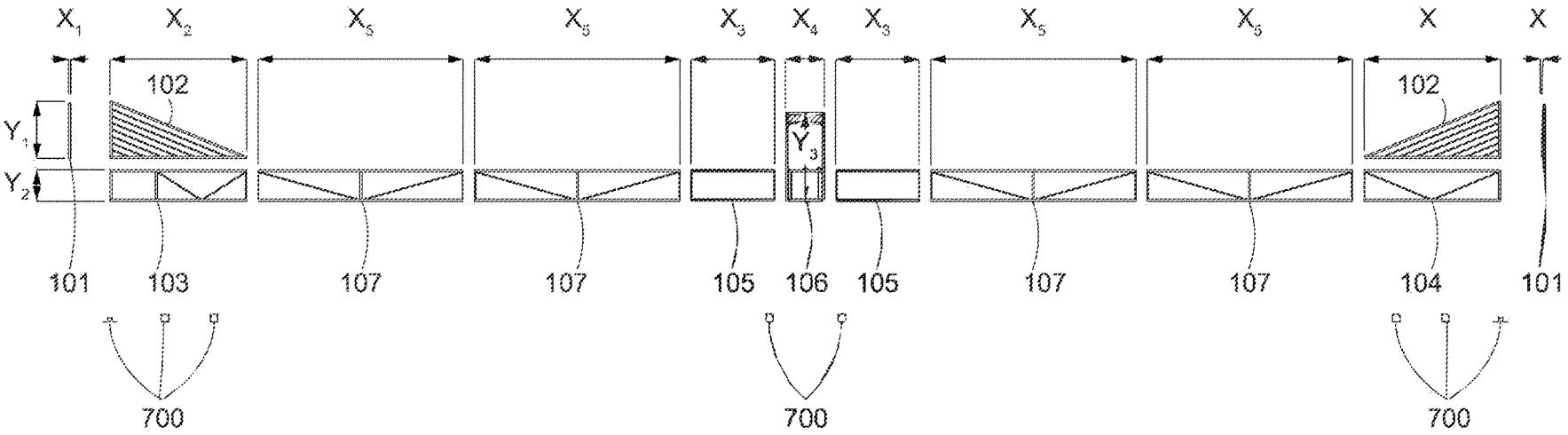
Figure 2D:
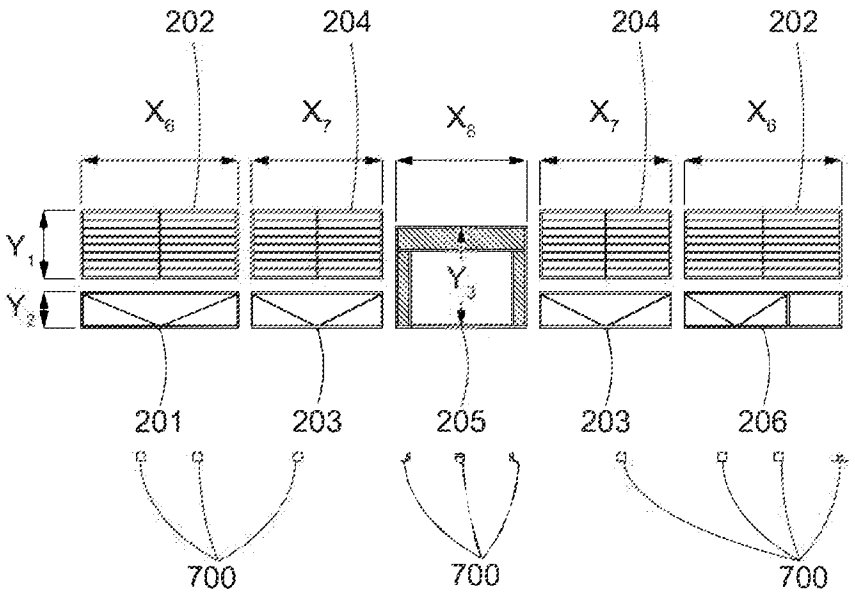
Figure 2E:
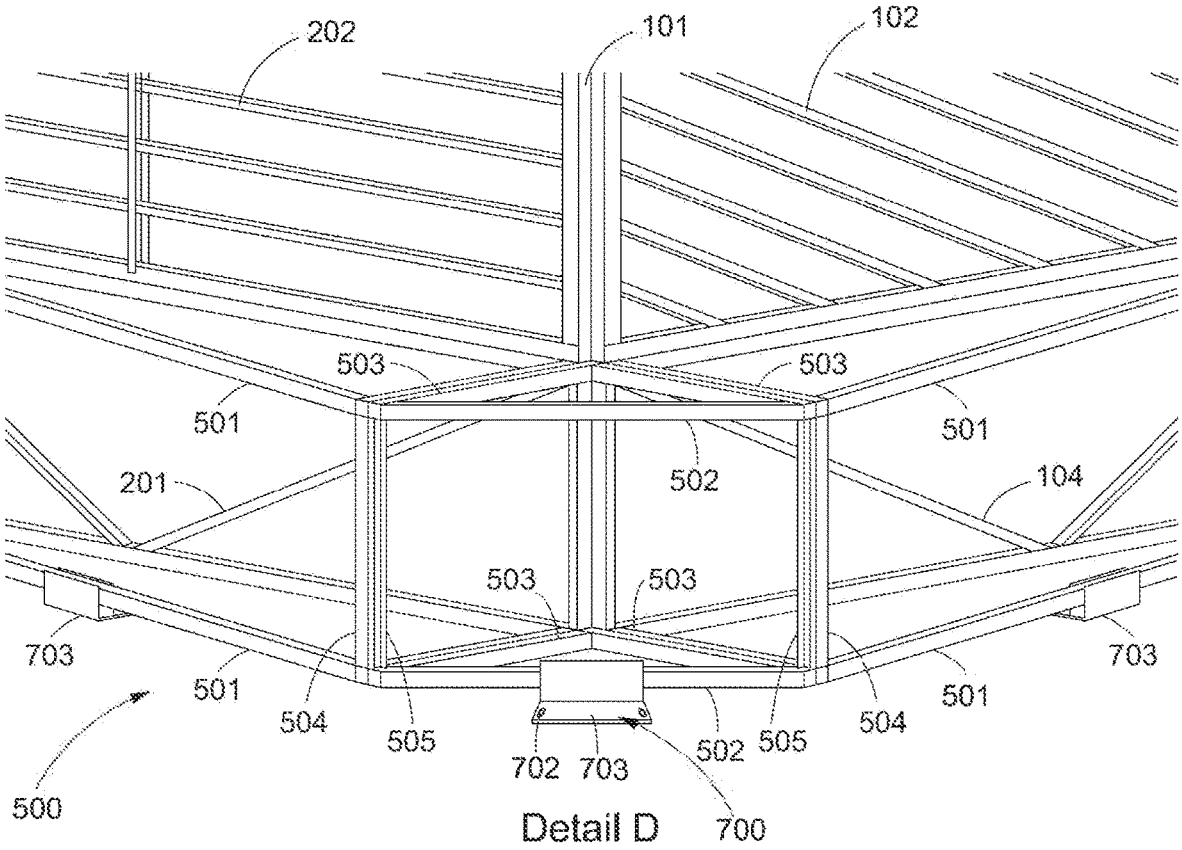
Figure 2F:
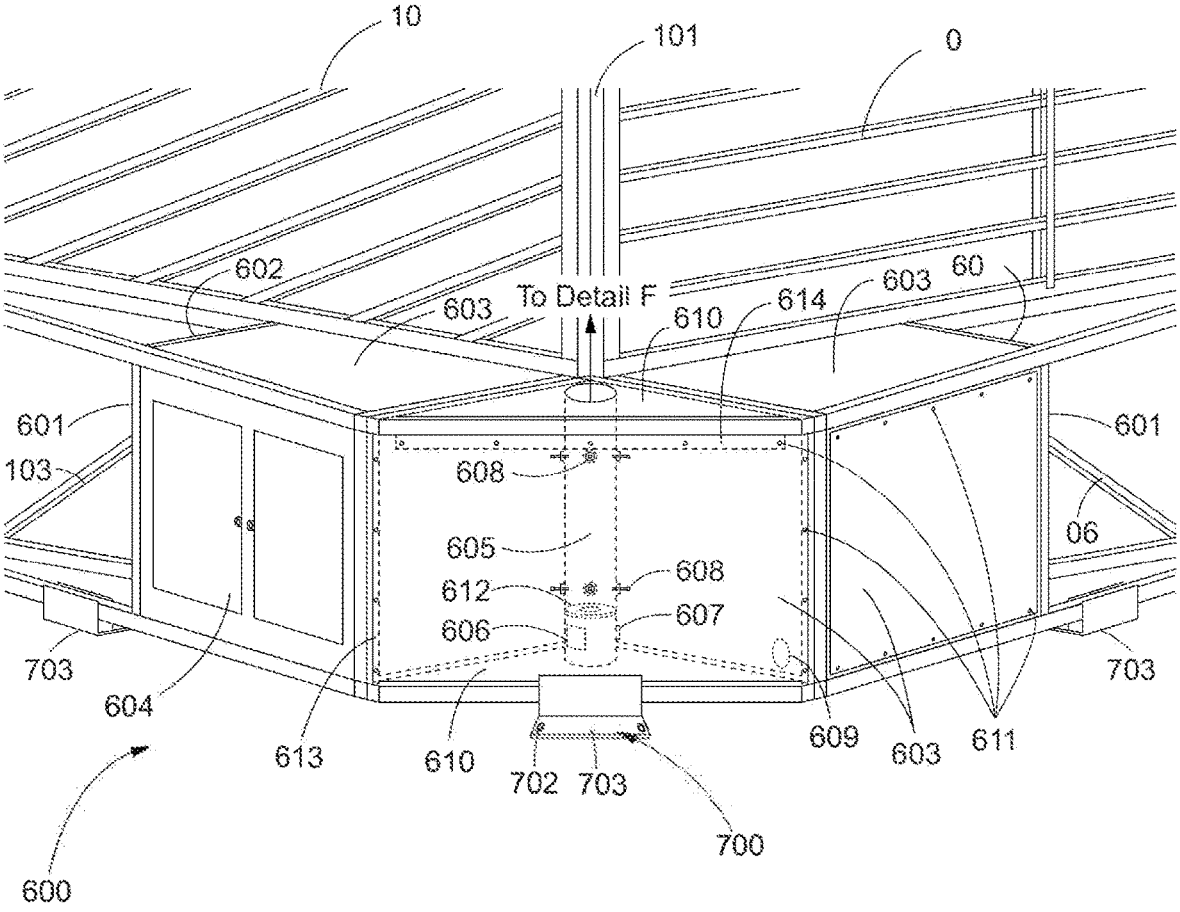
Figure 2G:
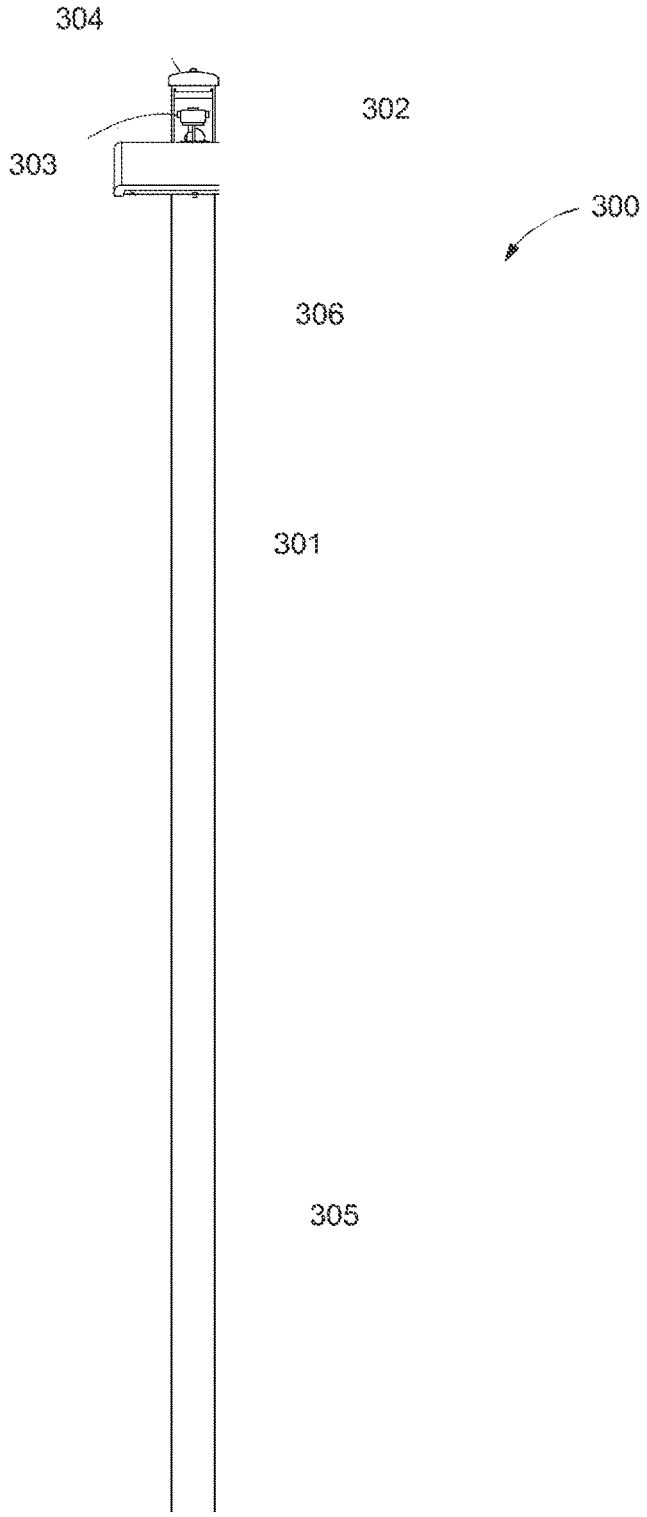
Figure 2H:
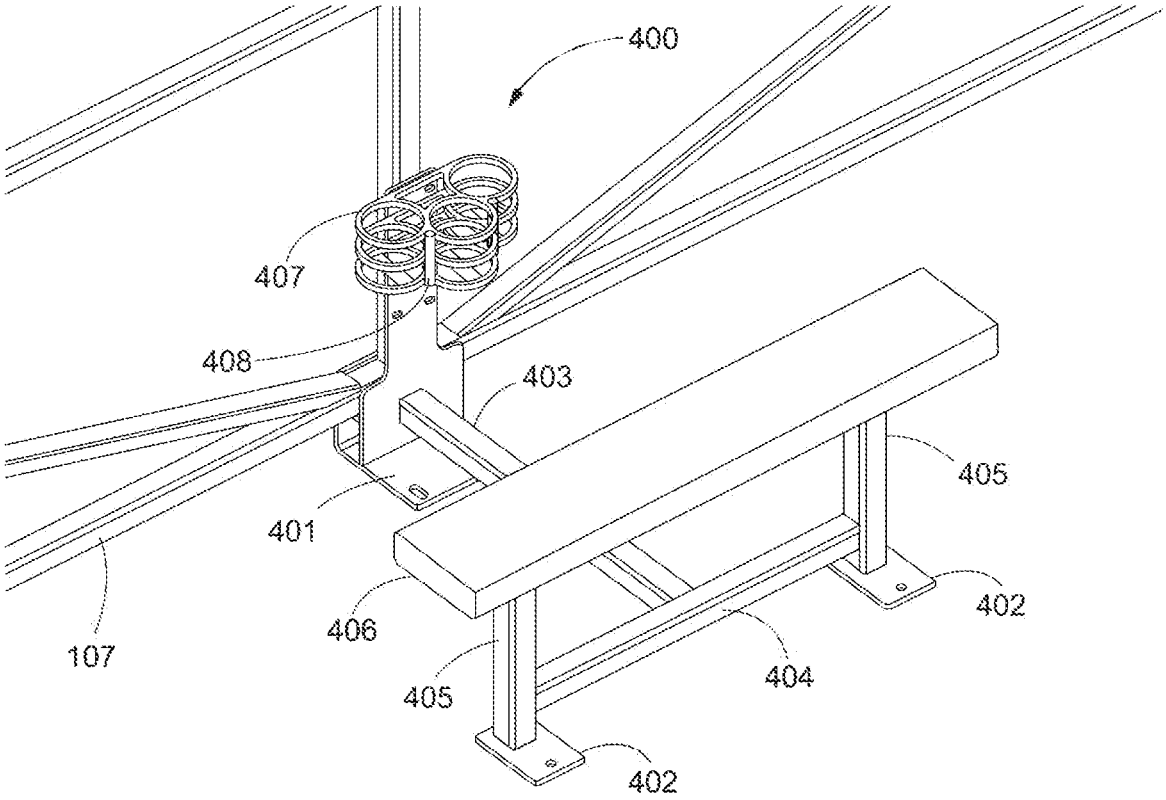
Figure 2I:
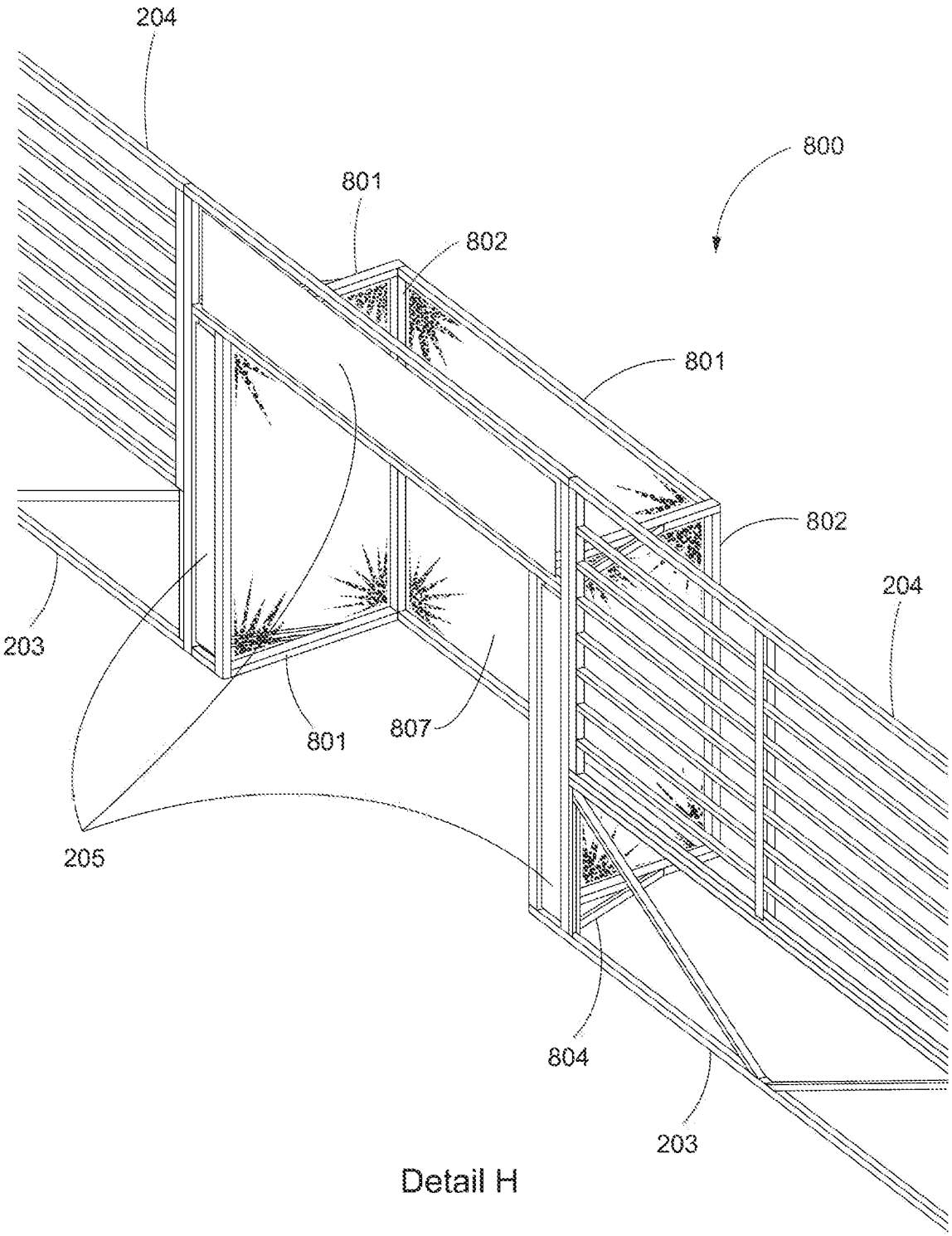

FIGS. 2A-I illustrates various views of the individual components which together form a soccer mini-pitch system such as that illustrated in FIG. 1B. FIG. 2A illustrates a top view of the system, FIG. 2B illustrates an enlarged exploded unassembled view (looking away from center field) of Detail A of FIG. 2A, FIG. 2C illustrates an enlarged exploded unassembled view (looking away from center field) of Detail B of FIG. 2A, FIG. 2D illustrates an enlarged exploded unassembled view (looking away from center field) of Detail C of FIG. 2A, FIG. 2E illustrates an enlarged cut-away perspective view (looking towards center field) of Detail D of FIG. 2A, FIG. 2F illustrates a partial enlarged cut-away perspective view (looking towards center field) of Detail E of FIG. 2A, FIG. 2G illustrates Detail F of FIG. 2F (which is the remaining portion of the enlarged perspective view looking towards center field at Detail E of FIG. 2A), FIG. 2H illustrates an enlarged cut-away perspective view (looking towards center field) of Detail G of FIG. 2A (note that for clarity fastening devices associated with the component have been omitted), and FIG. 2I illustrates an enlarged cut-away perspective view (looking away from center field) of Detail H of FIG. 2A.

Figure 3:
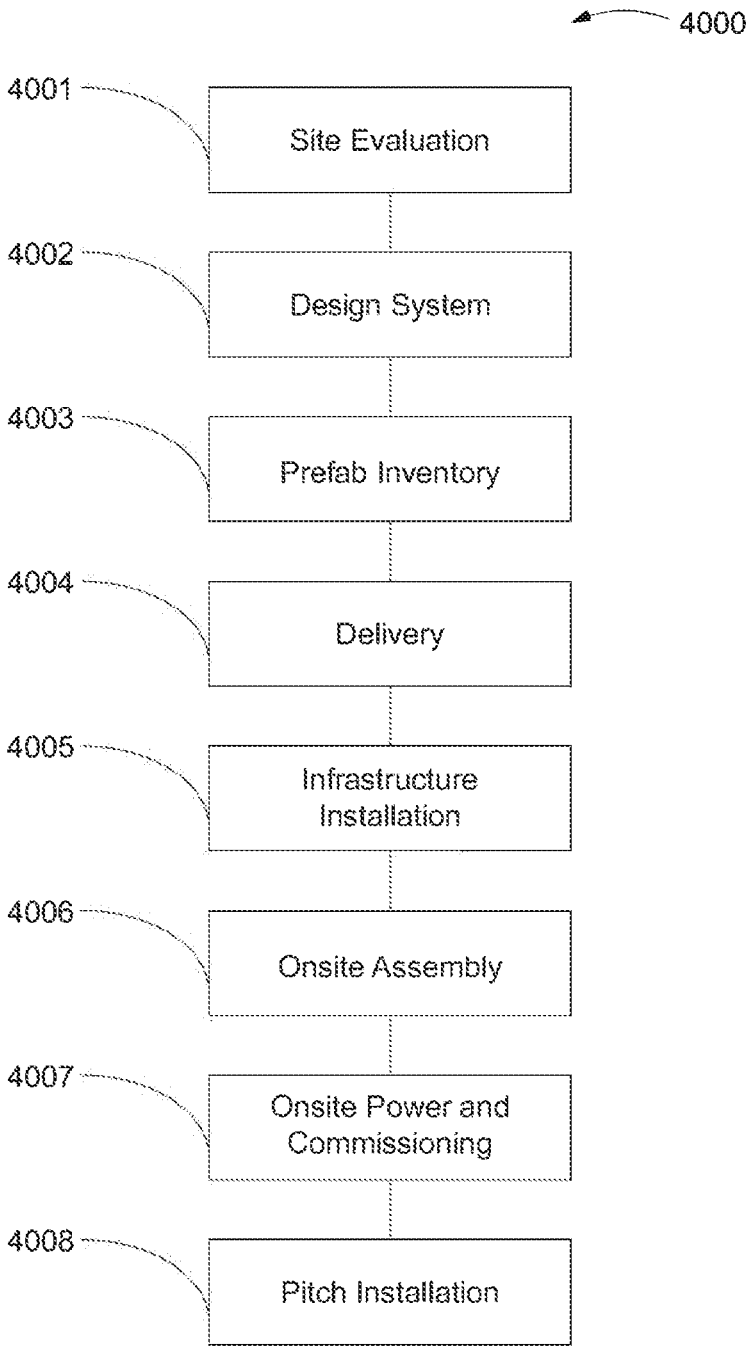

FIG. 3 illustrates one possible method of designing and installing a soccer mini-pitch system as illustrated and described, according to aspects of the present invention.

Figure 4A:
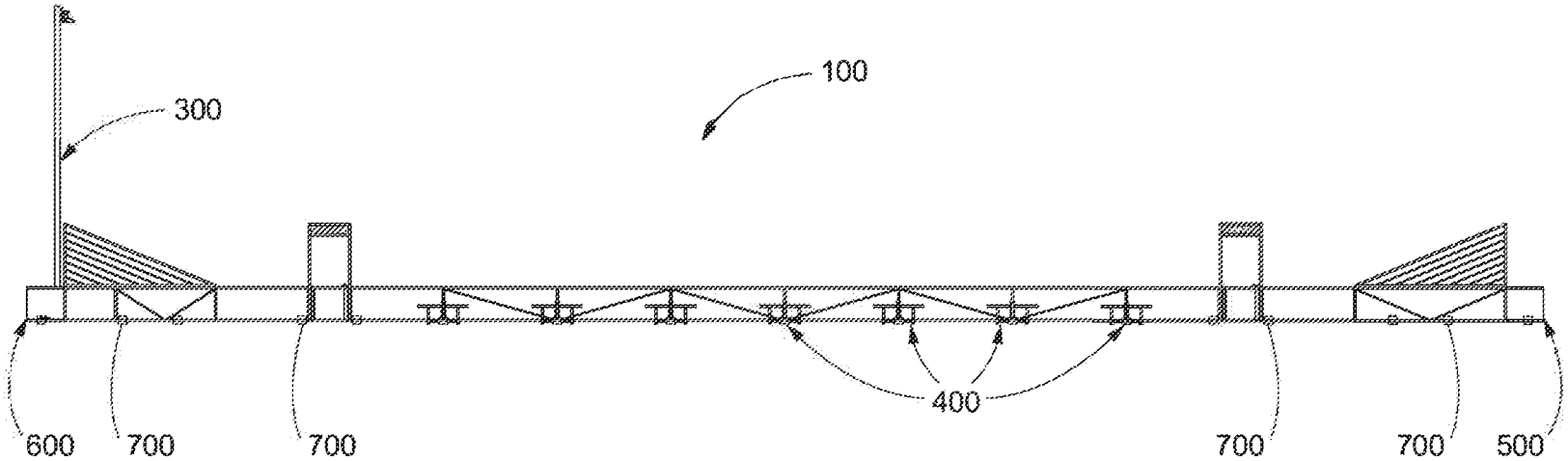
Figure 4B:
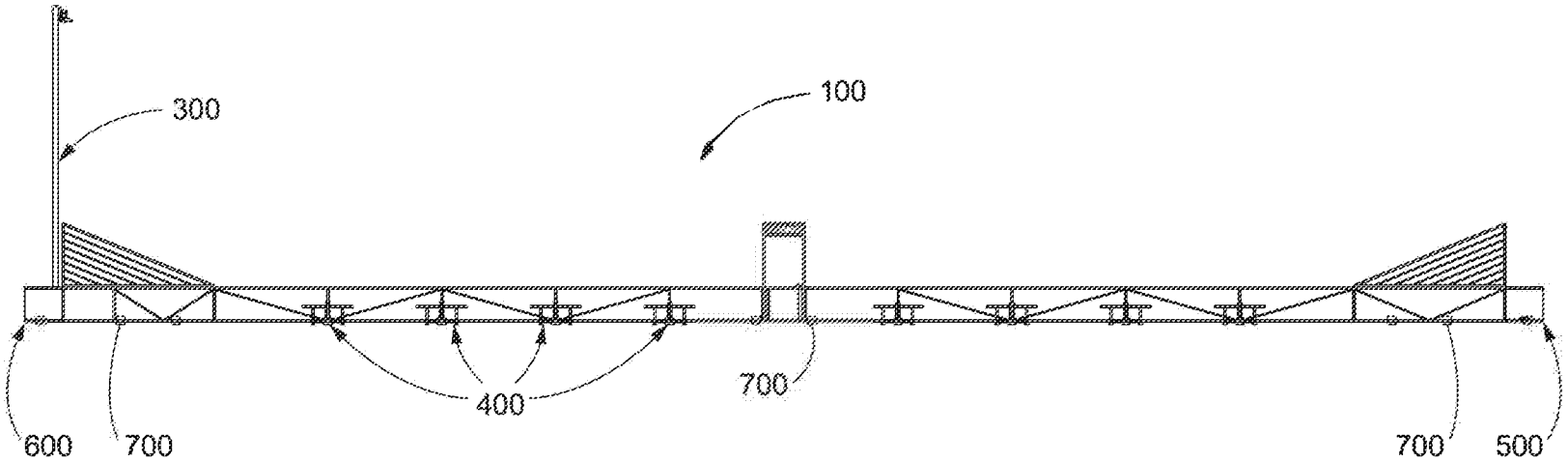
Figure 4C:
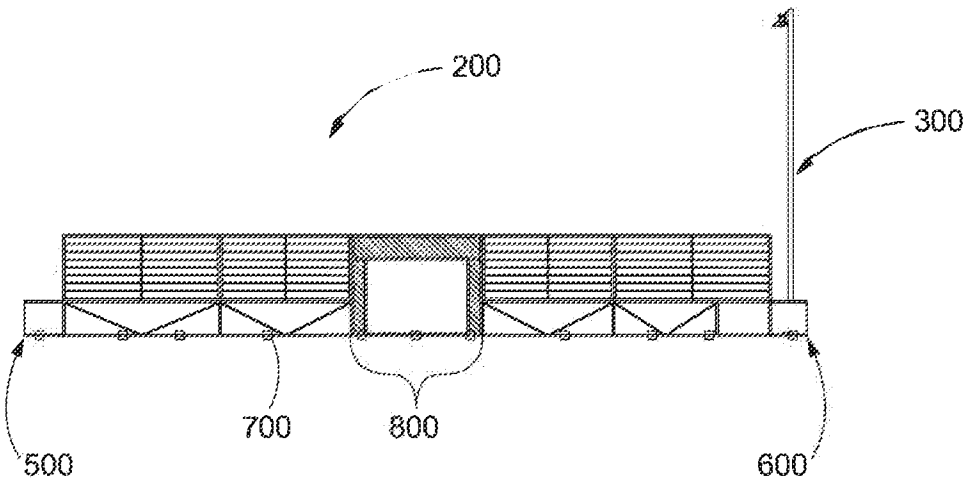
Figure 4D:
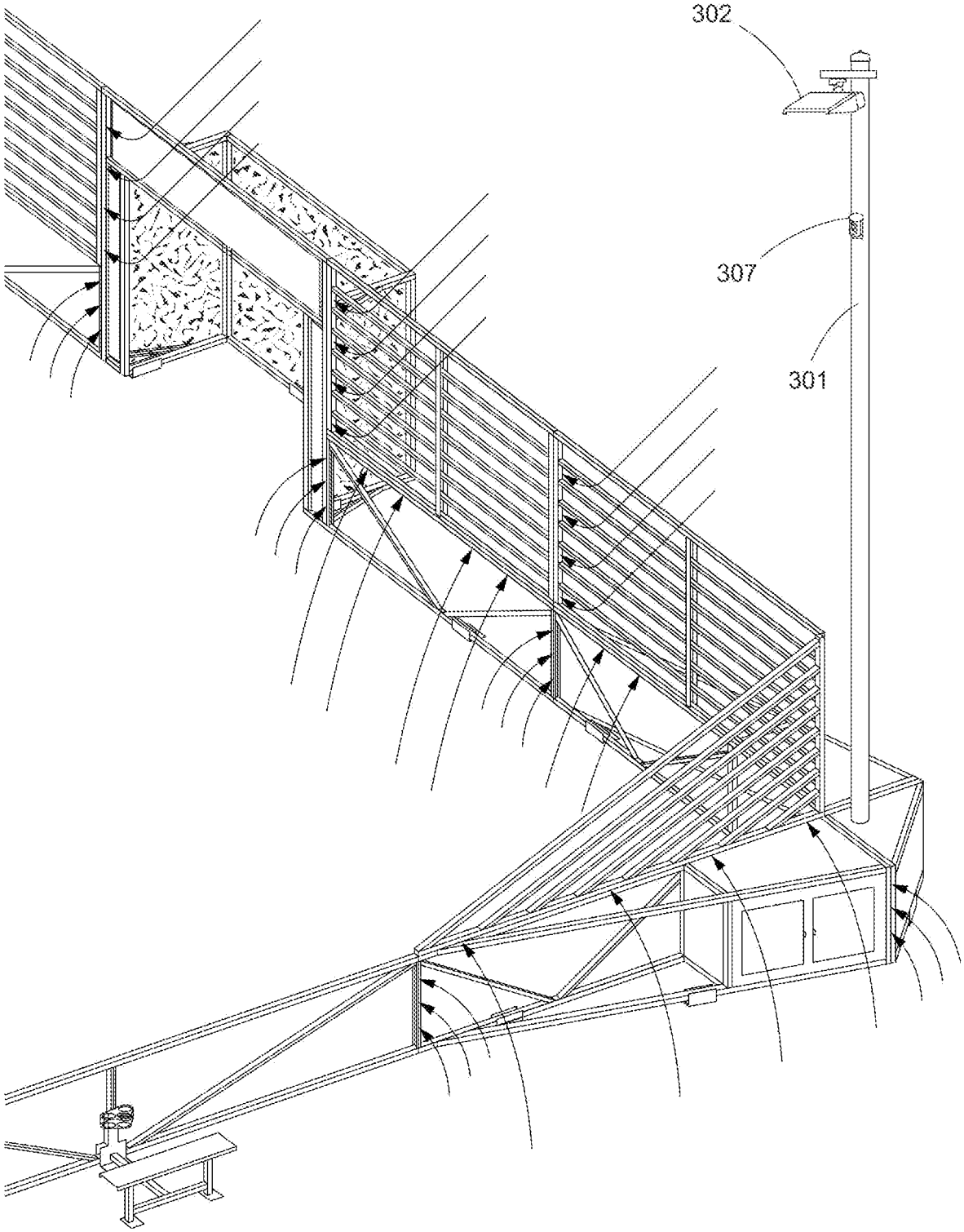
Figure 4E:
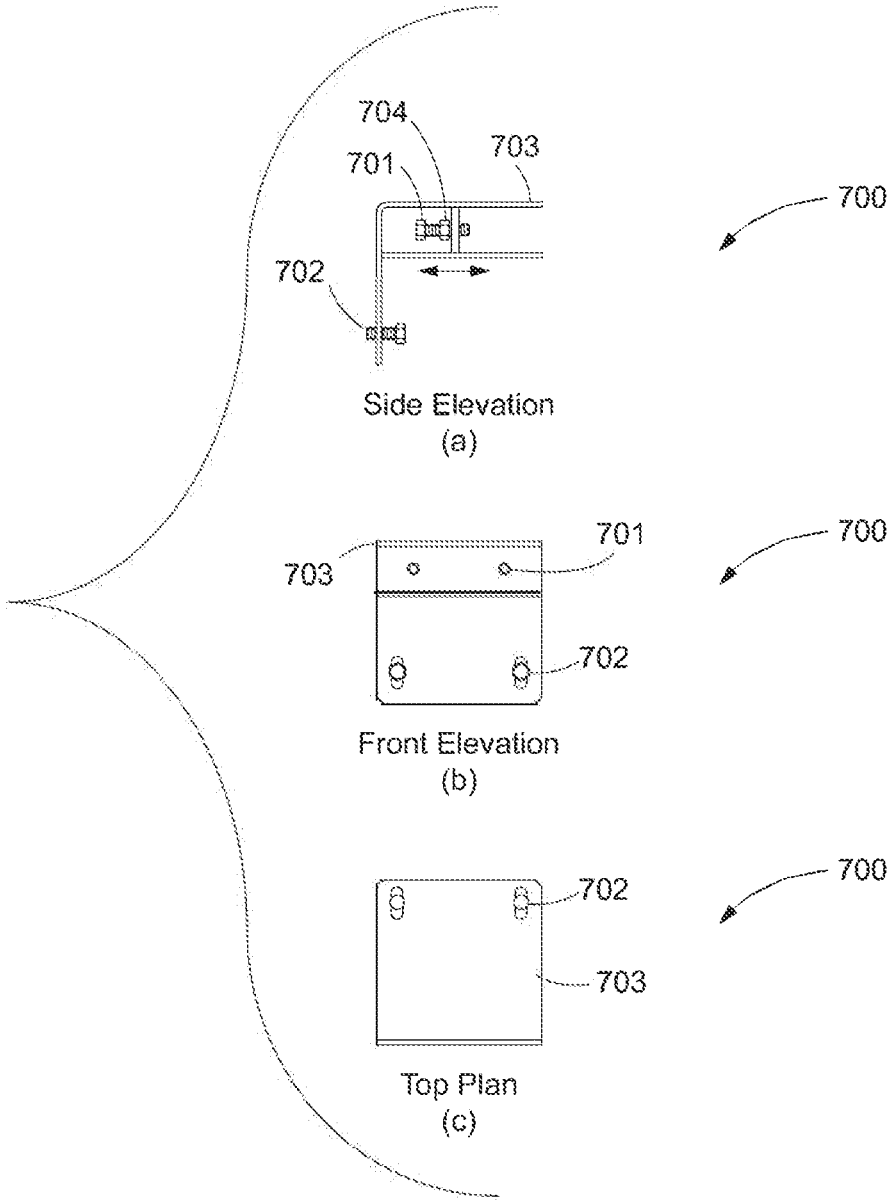

FIGS. 4A-C illustrate the individual components of FIGS. 2A-I assembled into sides of the soccer mini-pitch system according to aspects of the present invention. FIG. 4A illustrates a left side view from a center field position (similar to Detail A of FIG. 2B), FIG. 4B illustrates a right side view from a center field position (similar to Detail B of FIG. 2C), and FIG. 4C illustrates a top side view from a center field position (similar to Detail C of FIG. 2D). FIG. 4D illustrates via arrows some of the many connection points between modular components that form the soccer mini-pitch system according to aspects of the present invention. FIG. 4E illustrates side elevation (a), front elevation (b), and top plan (c) views of leveling feet used in FIGS. 4A-D.

Figure 5A:
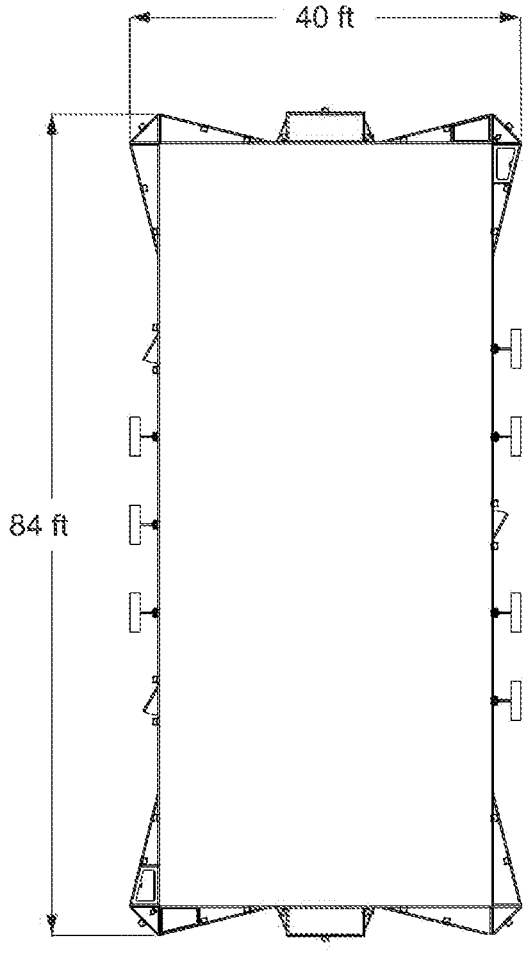
Figure 5B:
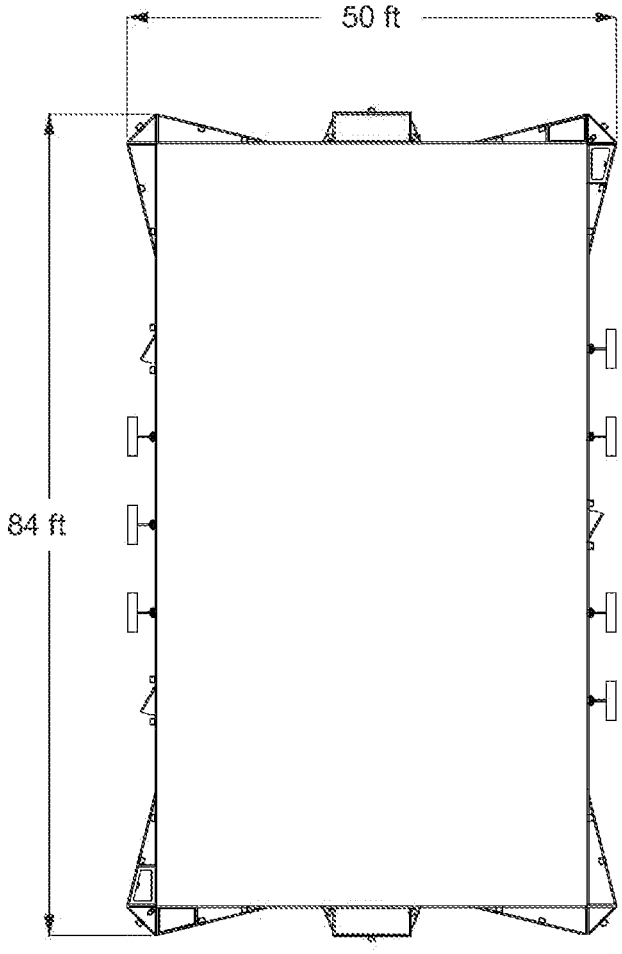
Figure 5C:
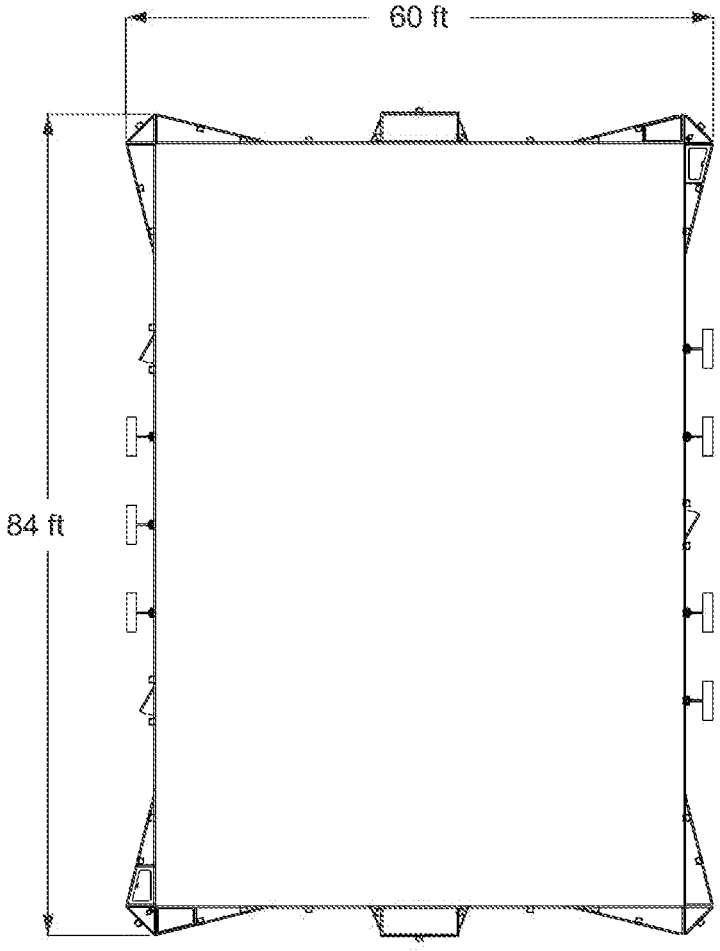
Figure 5D:
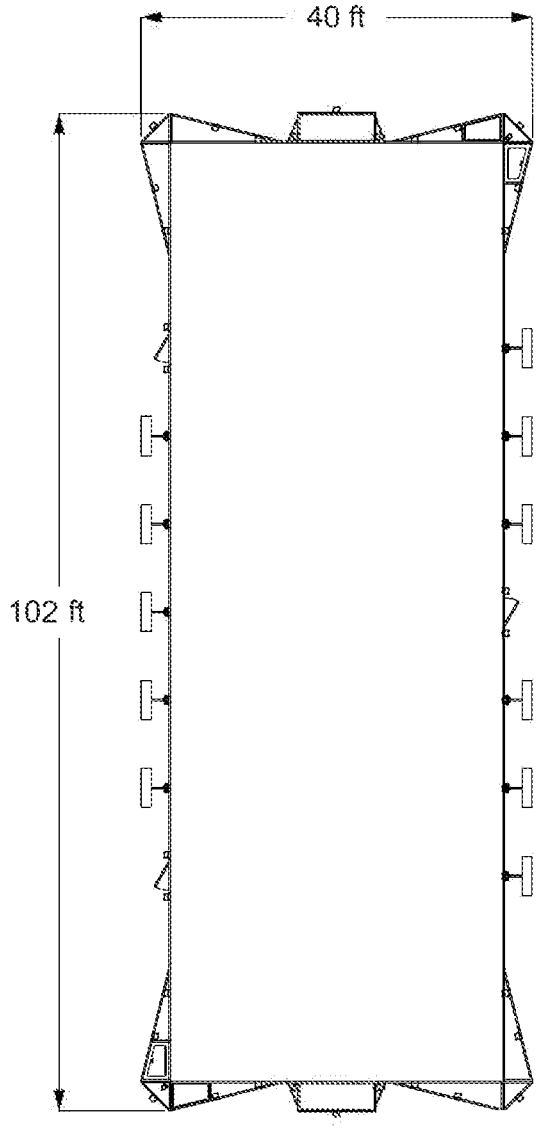
Figure 5E:
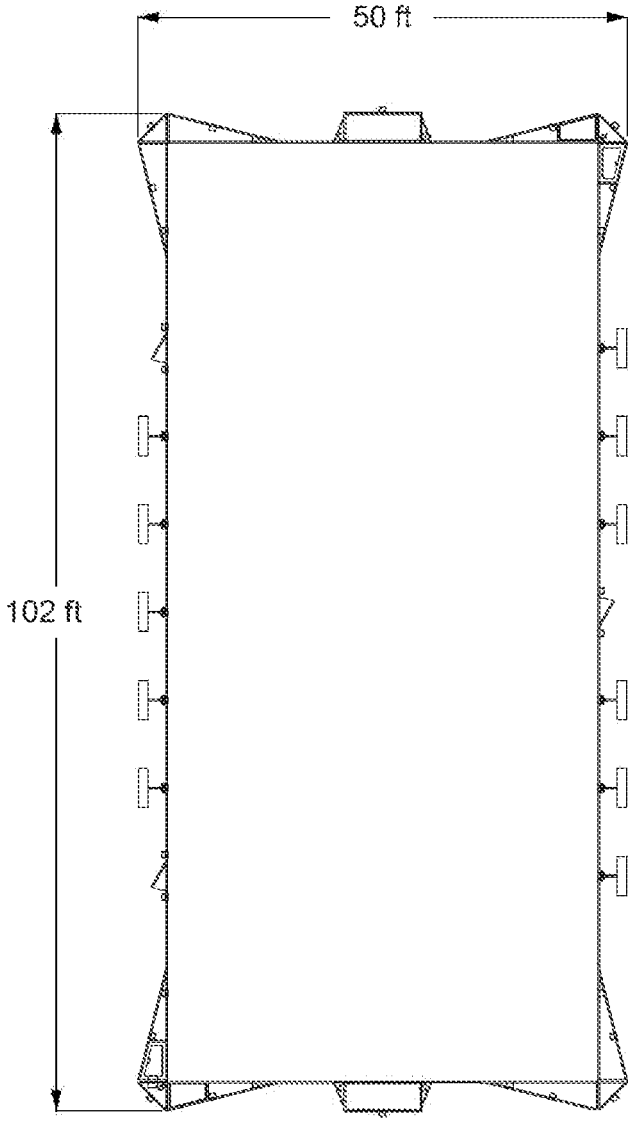
Figure 5F:
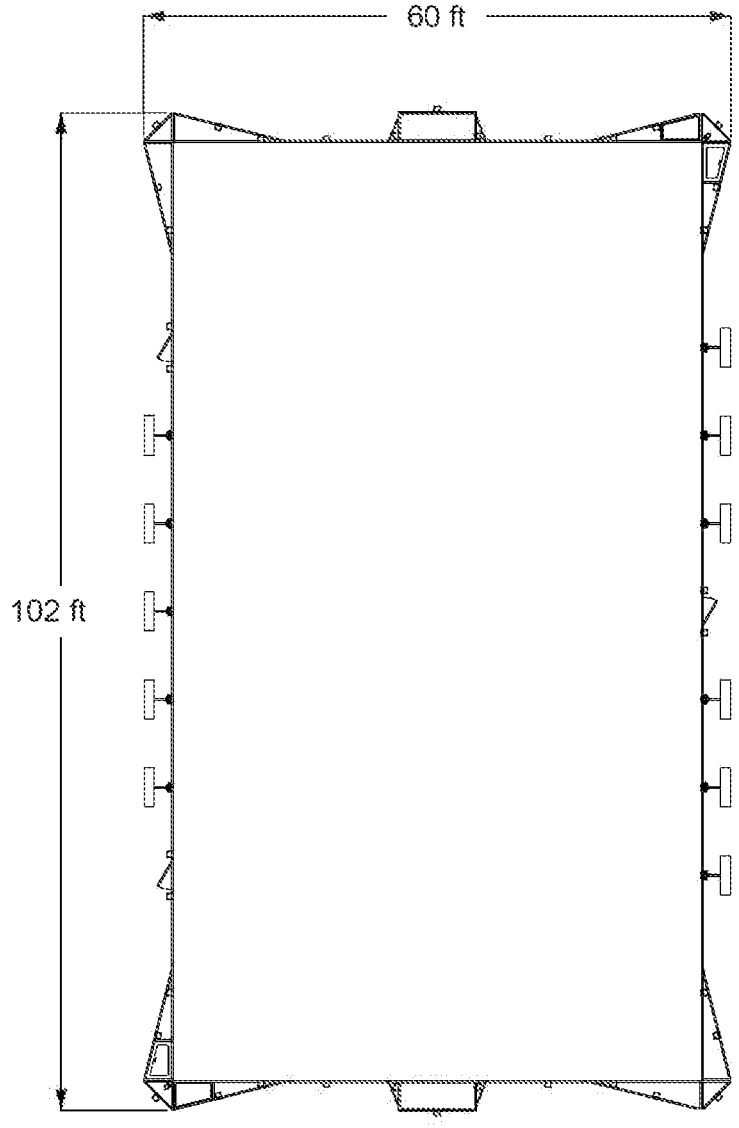
Figure 5G:
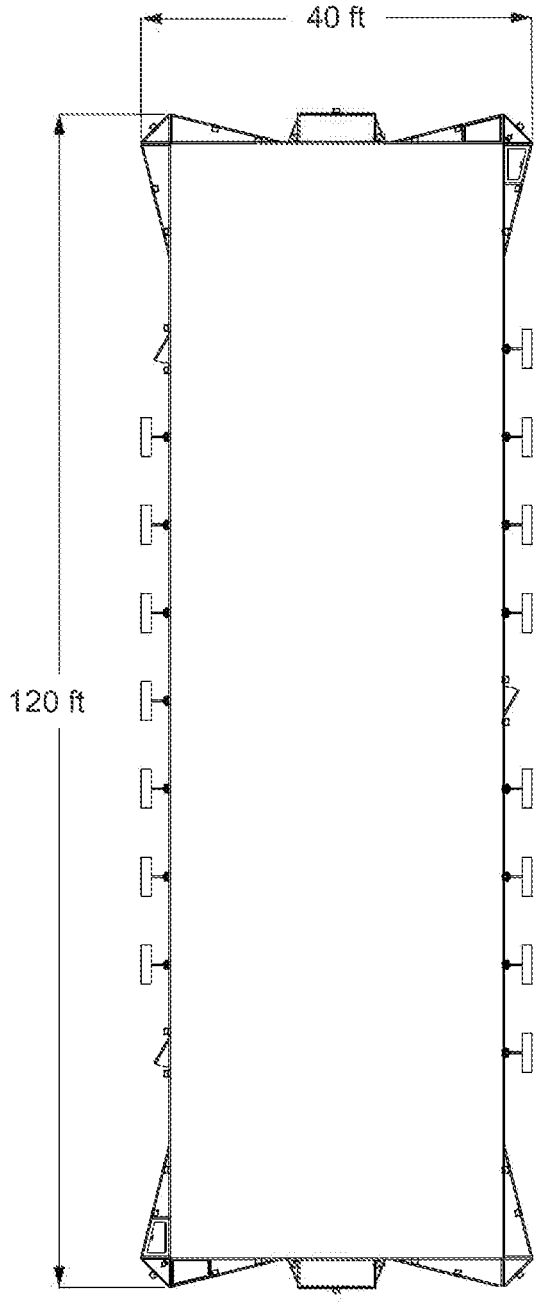
Figure 5H:
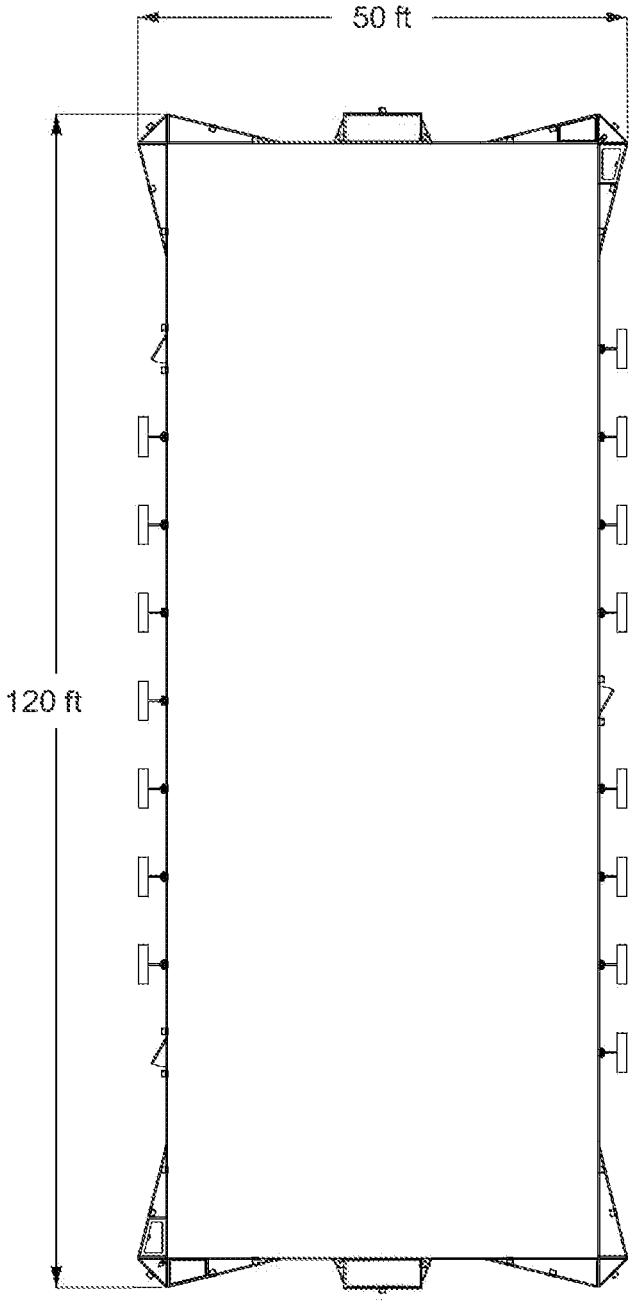
Figure 5I:
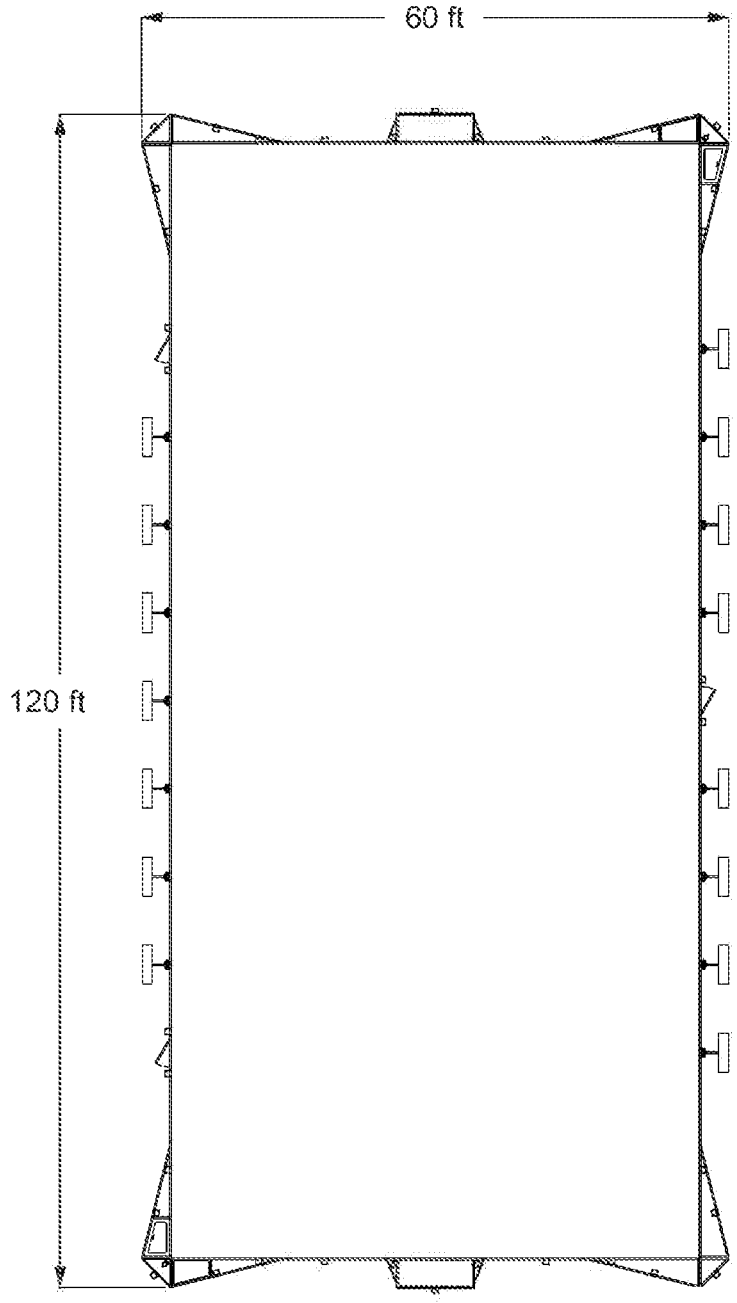
Figure 5J:
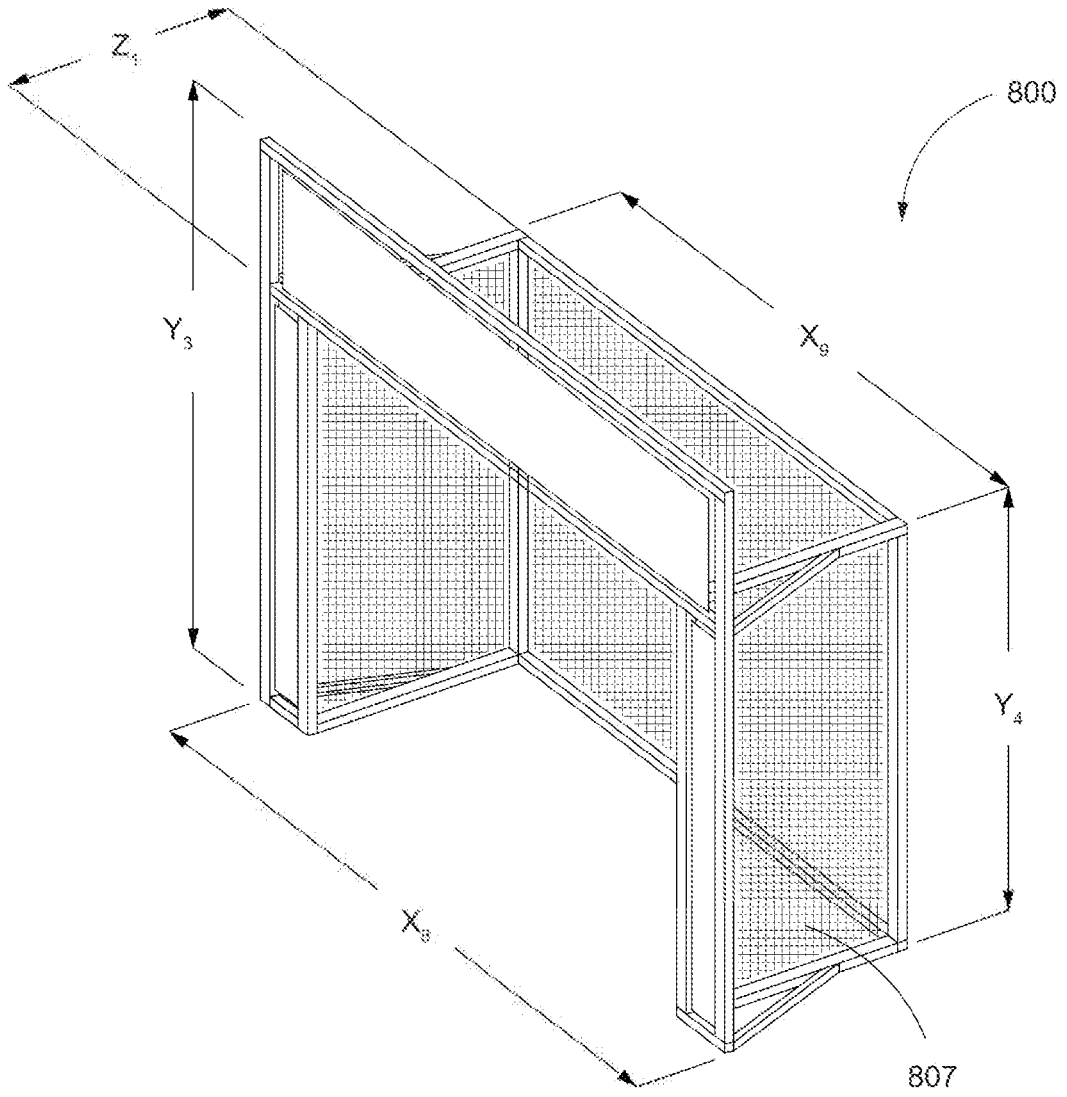
Figure 5K:
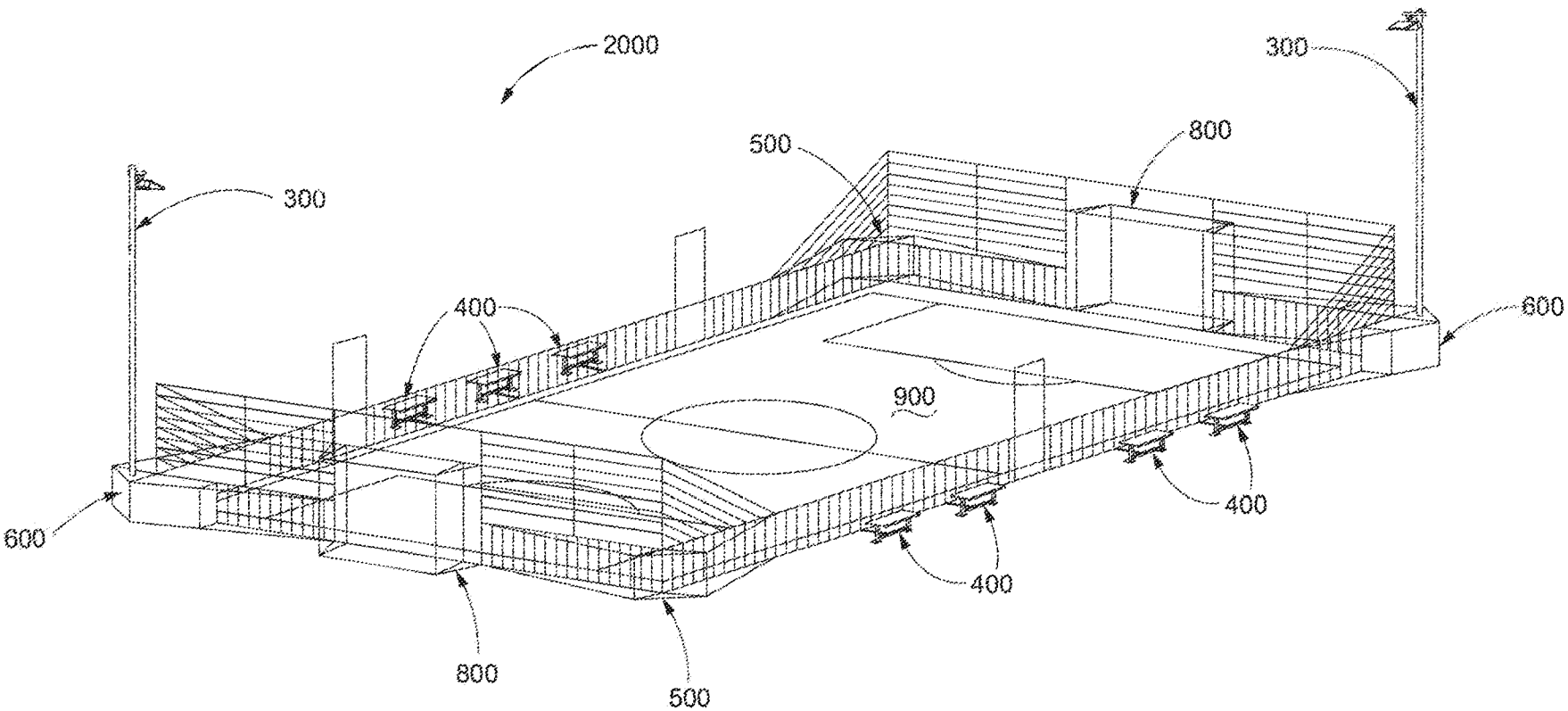
Figure 5L:
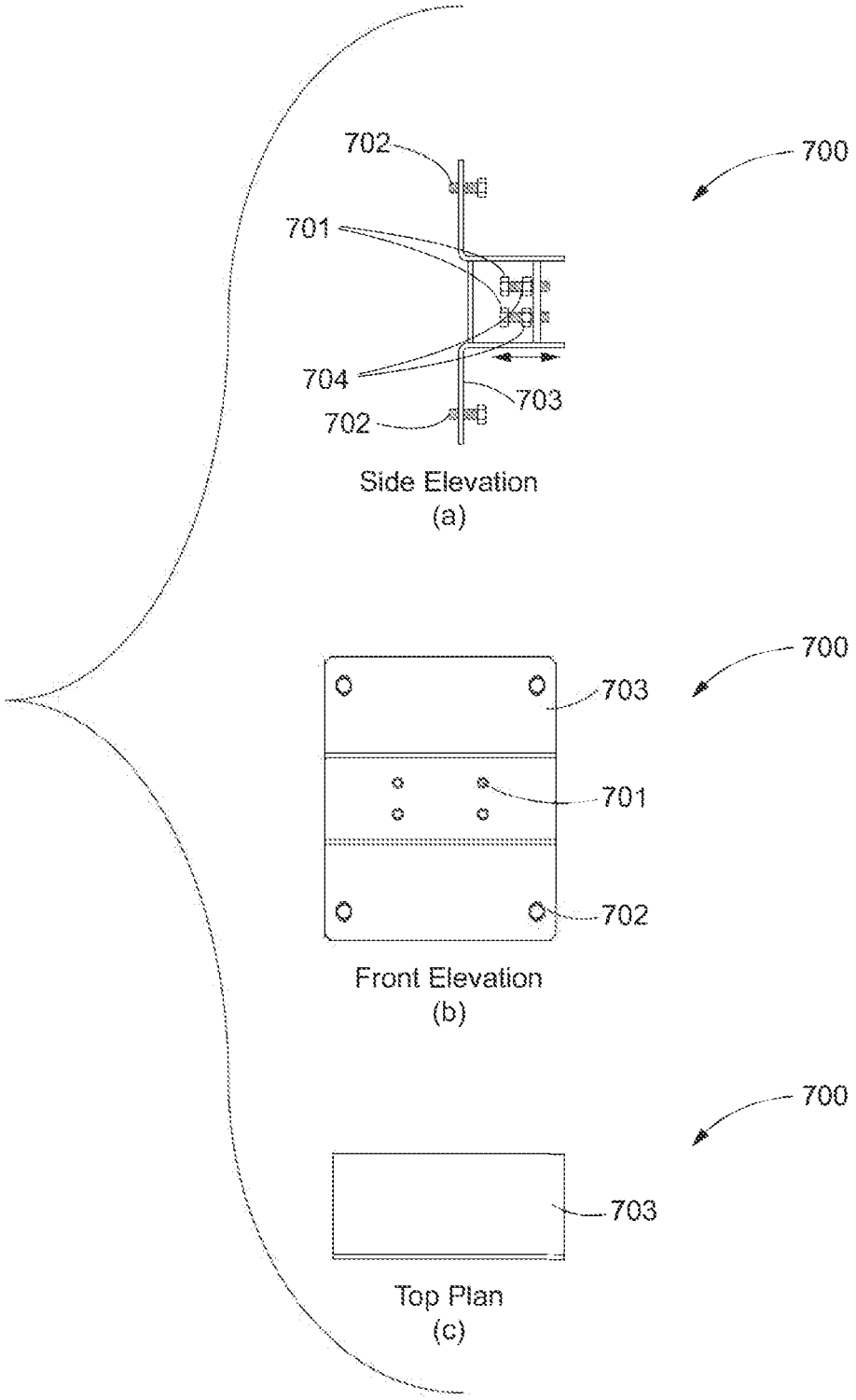
Figure 6A:
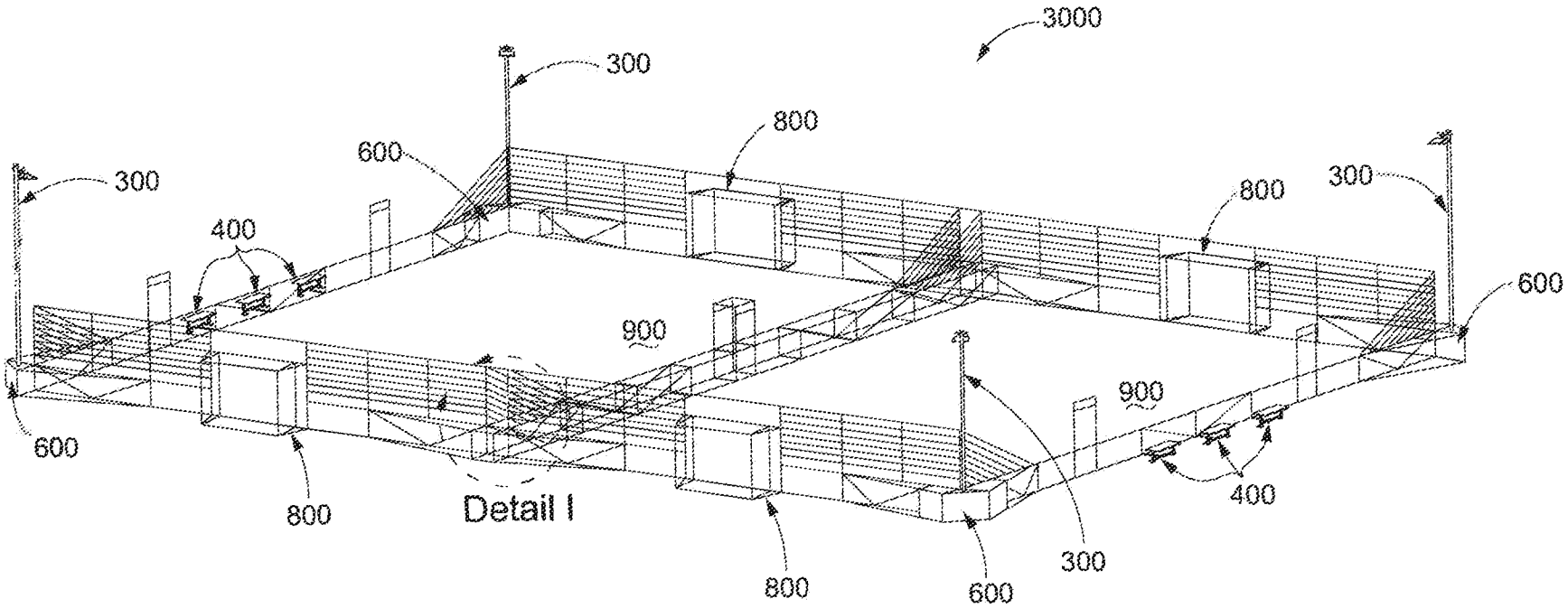
Figure 6B:
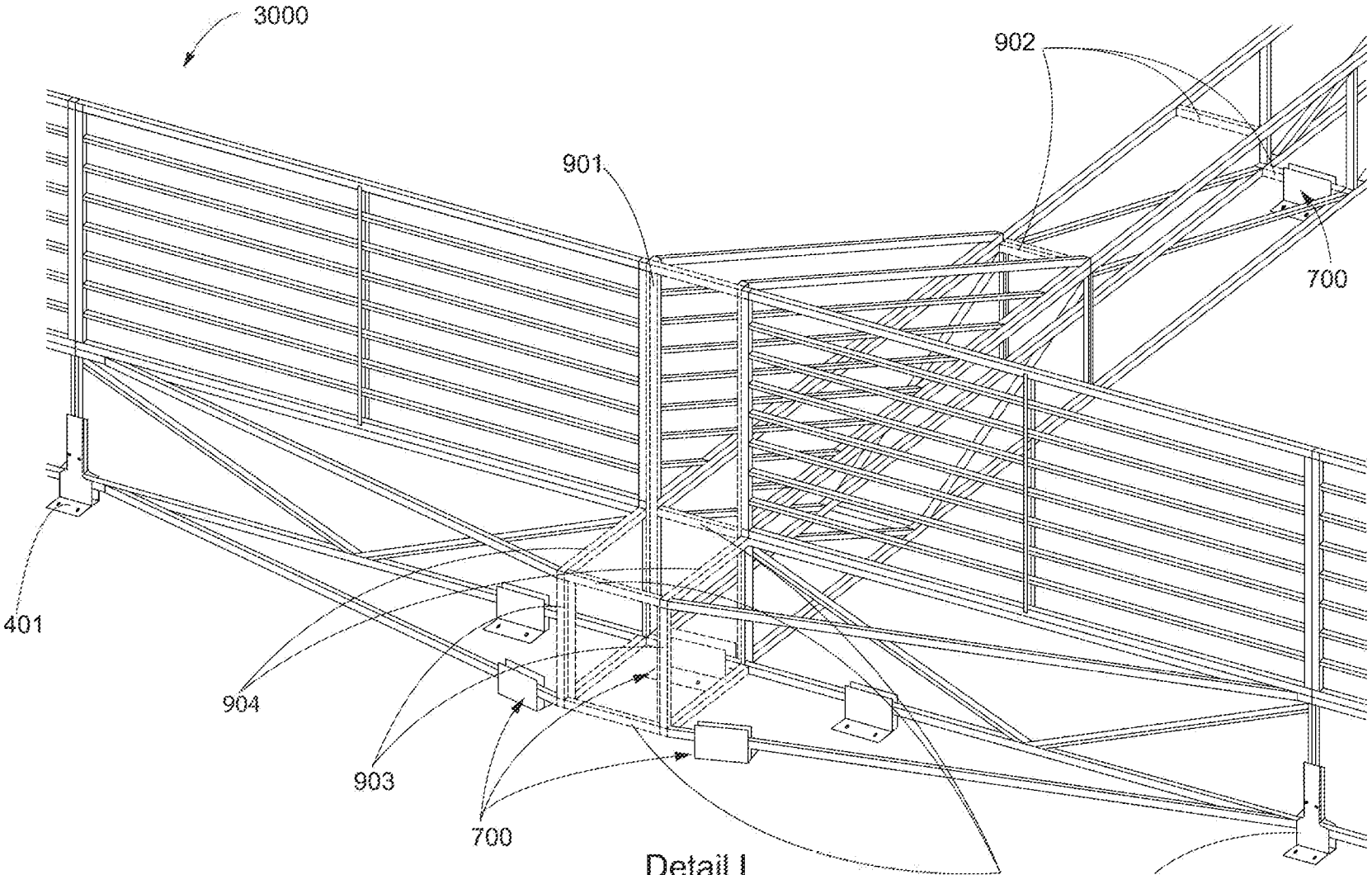
Figure 6C:
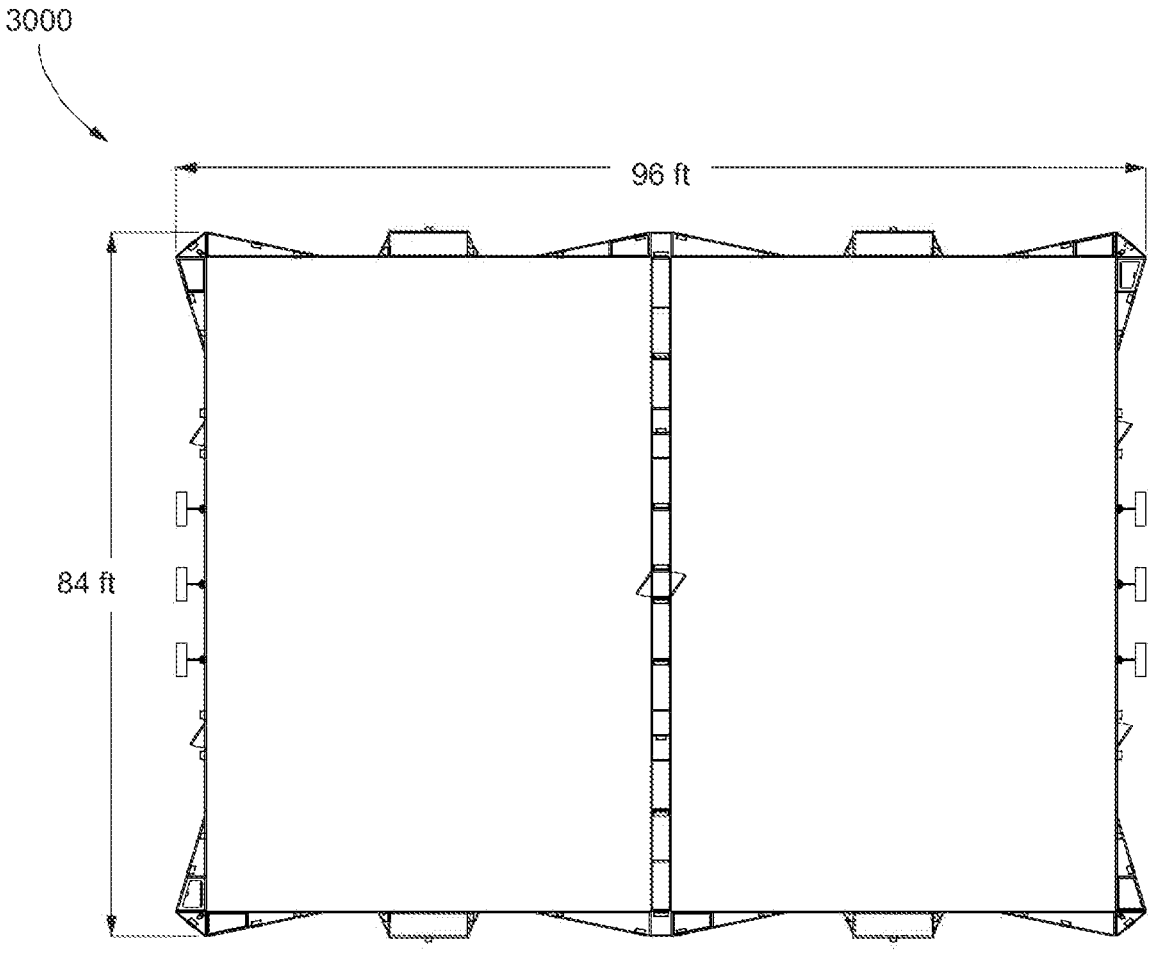
Figure 7:
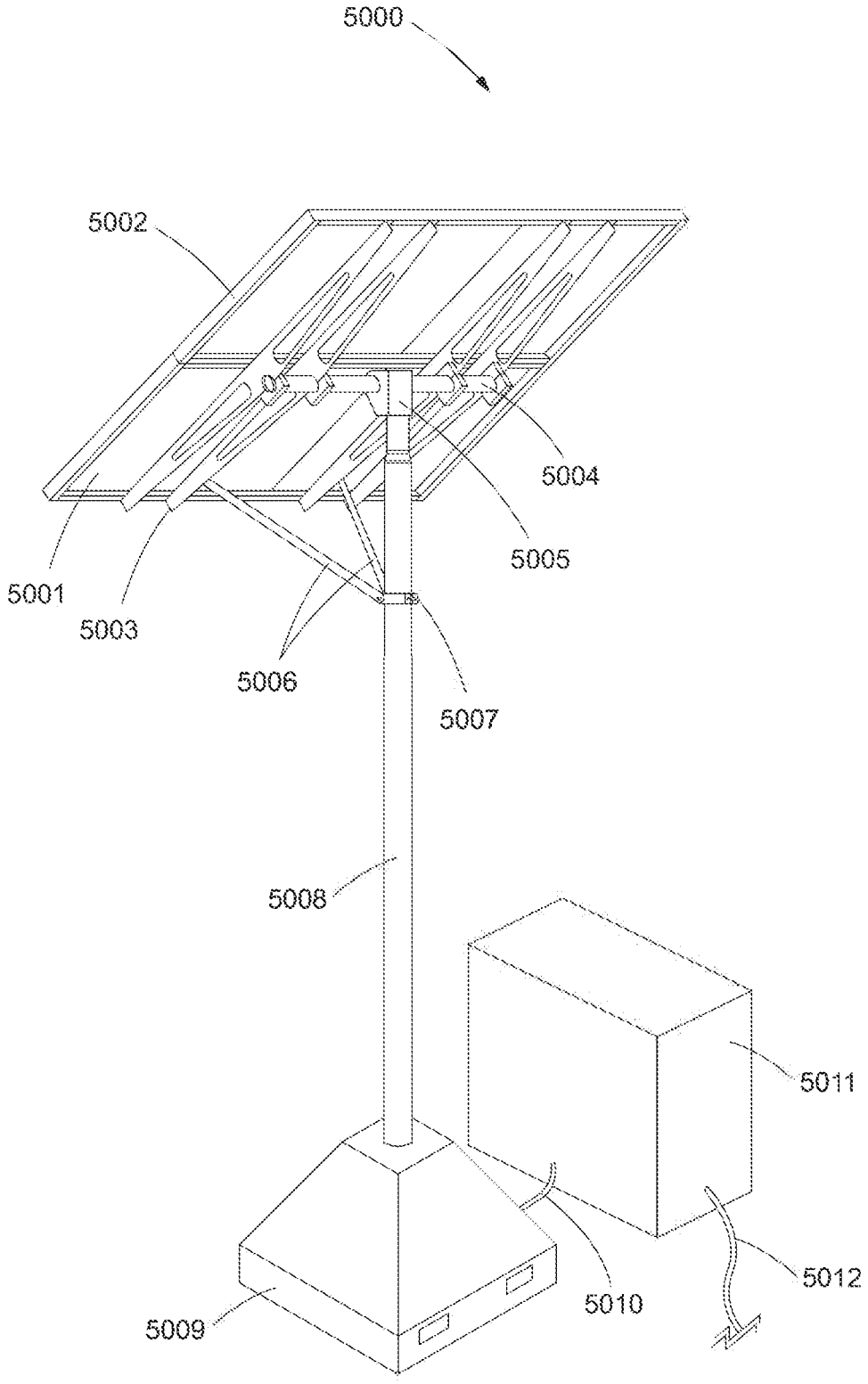

FIGS. 5A-7 illustrate various options and alternatives according to aspects of the present invention. FIGS. 5A-I illustrate top views of some possible pitch sizes which can be produced using the modular components of FIGS. 2A-I. FIG. 5J illustrates an alternative material for use in the goal component of FIG. 2I. FIG. 5K illustrates an alternative design of the structural components of FIG. 2B-D. FIG. 5L illustrates side elevation (a), front elevation (b), and top plan (c) views of an alternative design of the leveling feet of FIG. 4E. FIGS. 6A-C illustrate various views of a possible double pitch solution which can be produced using the modular components of FIGS. 2A-I with additional components; FIG. 6A illustrates a perspective view; FIG. 6B illustrates a partial enlarged cut-away perspective view (looking towards center field) of Detail I of FIG. 6A, and FIG. 6C illustrates a top view. FIG. 7 illustrates one possible power means for use in the soccer mini-pitch system.

V. DETAILED DESCRIPTION OF EXEMPLARY EMBODIMENTS

A. Overview

To further an understanding of the present invention, specific exemplary embodiments according to the present invention will be described in detail. Frequent mention will be made in this description to the drawings. Reference numbers will be used to indicate certain parts in the drawings. Unless otherwise stated, the same reference numbers will be used to indicate the same parts throughout the drawings.

Regarding terminology, a number of terms are used interchangeably herein: pitch, field, and playing surface are one example. The terms space and venue are used interchangeably herein; this is likewise true of amenities versus features. Use of one term versus another is merely for convenience, and no one term should be considered to purport limitations not explicitly stated herein.

With further regards to terminology, aspects of the present invention are described in the context of a system, one or more sides, and one or more components. Generally speaking, the components form the most basic building blocks of the invention, each component including a number of portions, units, fasteners, devices, etc. which contribute to overall functionality. For example, reference is given herein to a pole component. The pole component is considered a single component, even though in addition to a pole there are many electrical connections, structural portions, fasteners, etc. associated therewith which may be added, omitted, or shared with other components depending on the particular solution. The pole component is used with other components to build up a system, the system having one or more sides; for the case of single pitch soccer four sides, and for the case of double pitch soccer at least five sides. This modular approach provides a common infrastructure and a common inventory of prefabricated components from which many combinations of solutions may be produced for different spaces. So it can be appreciated that a "system" produced according to aspects of the present invention may look and function differently than another system produced according to aspects of the present invention, may have a different number of sides than another system produced according to aspects of the present invention, and a different number of components (either in total or within a side) than another system produced according to aspects of the present invention. Yet all are possible, and envisioned, according to aspects of the present invention.

By way of introduction, consider a standard soccer venue such at that in FIG. 1A. Typically, soccer venue 1000 includes, at a minimum, a field with lines 1001, goals 1002, seating 1003, and lighting 1004; dimensions X and Y can vary depending on level of competition, age, and the like, but can reach approximately 240' and 360', respectively. As previously discussed, neighborhood spaces can lack the space for a standard soccer venue so youth development programs often install mini-pitches including field with lines 1001 and at least one goal 1002; dimensions X and Y can be as small as 40' and 80', respectively. Conventional mini-pitch systems lack such features as seating and lighting, and it is simply not practical to apply seating 1003 and lighting 1004 from a standard soccer venue to a mini-pitch venue as (i) space is limited, and (ii) delivery of such large items would likely require a large commercial vehicle (which cannot be maneuvered in compact residential or urban areas).

FIG. 1B illustrates generally a soccer mini-pitch system according to aspects of the present invention. Soccer mini-pitch system 2000 still includes goals (800) and a field with lines (900), but aforementioned seating and lighting (400 and 300, respectively) are also included and operationally connected to the goals via a common infrastructure that provides not only rigidity and structure (500), but also added value in terms of onsite storage (600). In practice, the number and layout of components which form soccer mini-pitch system 2000 will depend on community needs and neighborhood space restrictions, but in all cases can be selected from a group of prefabricated components so to (i) reduce cost (e.g., of parts, manufacturing, assembly, and maintenance) and (ii) aid in reliability and ease of installation.

A more specific embodiment utilizing aspects of the general example above will now be described.

B. Exemplary Apparatus and Method Embodiment 1

Turning to FIG. 2A—which shows a top view of a 60'×120' field based on the generic example of FIG. 1B—one can get a sense of the components which form the system for this specific example. FIGS. 2B-I illustrate the components in greater detail, and are presently discussed.

1. Structural Components (FIGS. 2B-D)

According to the present embodiment, components are formed from 11 gauge, 2×2 A500 structural steel square tubing and/or 2" depth, 0.120" thick channel bar (or in some cases angle iron) so to provide rigidity, corrosion protection, impact resistance (e.g., from errant balls), and weather hardiness; said materials could be obtained from Ryerson Holding Corporation, Chicago, Ill., USA, though, of course, this could differ in material type, dimensions, and supplier. Each of components 101-107 and 201-206 is prefabricated and of a size to be transported on a standard flatbed truck (or standard shipping container); dimensions are listed in Table 1 below. In practice, one may build up a mini-pitch system of desired dimensions by selecting some number of the aforementioned components from an inventory, transporting them to a site via a standard over-the-road truck (e.g., such as is described in U.S. Pat. No. 6,692,142 incorporated by reference herein in its entirety), using a forklift to set the components into the desired configuration for the desired number of sides, and assembling the components (which is later discussed).

TABLE 1

| Reference | Dimension (in) |
|---|---|
| X1 | 2 |
| X2 | 144 |
| X3 | 88 |
| X4 | 40 |
| X5 | 216 |
| X6 | 144 |
| X7 | 120 |
| X8 | 120 |
| Y1 | 60 |
| Y2 | 33 |
| Y3 | 93 |

If desired, so-called wireropes (e.g., any model of galvanized aircraft cable available from www.webrigginsupply-.com) may be run horizontally (i.e., along the X dimension of FIGS. 2B-D) across one or more components to aid in keeping errant balls on the pitch; alternatively, vertically running (i.e., along the Y dimension of FIGS. 2B-D) bars formed from the same 11 gauge, 2×2 A500 structural steel square tubing (or otherwise) could be included for the same reason. Ultimately, any material which is cost-effective and easily prefabricated would seemingly be a good solution for keeping a ball on the pitch during play, but it has been found from testing any such material must also be rugged—testing with typical chain link fence showed extensive damage from ball impacts, even at youth recreational levels.

Rugged construction is not only necessary to prevent damage from ball impact, but also so the entire system can withstand anticipated wind loads; components 102 and the upper door frame of gate component 106 are specifically designed for this purpose. Further, while the system as designed is not required to be bolted down (e.g., so to accommodate communities having a ban on permanent installations or bolting components to the ground), doing so increases resistance to wind loads; the system illustrated in FIGS. 2A-I is designed to withstand winds up to 120 mph when bolted (later discussed).

2. Corner Components (FIGS. 2E and 2F)

Corner components aid in stabilizing the system, as well as providing surfaces and interfaces for added features. It should be noted, however, these benefits are provided regardless of whether components 500 and 600 form an actual corner or some other shape; for example, in the case of so-called Ga-ga ball pits, components 101-107 and 201-206 together with corner components 500 and 600 approximate more of a circle than a rectangle with actual corners—but the benefits from corner components are provided nonetheless.

Component 500 of FIG. 2E illustrates more of an open infrastructure in which the same 11 gauge, 2×2 A500 structural steel square tubing (see, e.g., 501-504) and 2" depth, 0.120" thick channel bar (see, e.g., 505) used in the construction of the structural components is used to form portions 501-505. Component 500 envelopes the structural components at each corner of the soccer mini-pitch system; note relative locations of components 101 (which is an angle iron), 102, 104, 201, and 202 (see also FIG. 2A). Of course, not all pitch is flat and not all neighborhood spaces are level. As such, leveling feet 700 (later discussed) are placed in one of two orientations under corner component 500, components in sides 100 and 200 (see FIGS. 4A-C), including corner component 600 (FIG. 2F); both orientations are illustrated in FIGS. 2E and F. Not only does this provide a leveling feature, but it allows the infrastructure of the mini-pitch system to "float" above the pitch (here, on the order of 6"); this preserves the pitch and aids in pitch maintenance insomuch that leaves, water, and debris on the pitch can easily be swept, blow, or washed away. The open spaces of component 500 can be used to house garbage cans, provide temporary storage (e.g., of bags of ball or jerseys), or provide an interface for hanging banners, flags, or advertisements (such as is described in U.S. Pat. No. 5,377,611 incorporated by reference herein in its entirety), for example.

Component 600 of FIG. 2F relies upon a similar infrastructure to component 500, but adds portions (e.g., 12 gauge galvanized steel plate) so to enclose otherwise open spaces and create discrete units; each of these units are pre-welded, prefabricated, and shipped to the venue. For example, channel bar portions 601 and 602 can be combined with plates 603 on five sides and plate with doors 604 to create an accessible, yet enclosed, space (e.g., for additional storage); this entire unit (the leftmost unit of FIG. 2F measuring approximately 50"×36" on its face and varying in depth from approximately 20" to 32") is prefabricated (e.g., welded at the factory) and shipped to the venue already attached to portions 501—so that no welding on site is required, and that when the entire unit is placed in abutment with portion 103, bolting with hand tools is all that is required for operation. If desired, a lock (not illustrated) could be provided to deter theft.

Alternatively, or in addition, channel bar portions 601 and 602 can be combined with plates 603 and tamper-resistant screws 611 on one or more sides (e.g., any model of passivated tamper-resistant Torx screws available from Mcmaster-Carr, Elmhurst, Ill., USA) to create an accessible space which is enclosed in situ and protected against theft and tampering—this is shown on the rightmost unit of FIG. 2F (which houses power means (e.g., generator, capacitors or other devices to regulate line power) for one or more devices of pole component 300 (later discussed) and measures approximately the same as the storage unit). Securing a plate 603 in situ can be achieved by a variety of means, but according to the present embodiment channel bar (see 601 and 602) may be drilled at the factory and weld nuts (e.g., any model of aligning weld nut available from aforementioned McMaster-Carr) welded thereto to produce channel bar with weld nuts on the back side (see 614 and 613, respectively) so that when a unit is prefabricated and shipped to the venue, wire can be pulled, devices installed, etc., plate 603 positioned on the front side (i.e., the non-weld nut side) of modified bars 613 and 614, and the unit secured against tampering with said tamper-resistant screws 611 on site using simple hand tools to seat screws 611 in corresponding weld nuts; this is illustrated for the center unit of FIG. 2F.

In terms of providing power or other communications from a device of component 600 and an elevated, electrically powered device of component 300, power wiring, sensor feedback wiring, etc. can be routed from the internal space of pole receiving portion 605, through a conduit or port 607, into the internal space formed by plates 603 and plates 610 (which are welded to pole receiving portion 605 prior to shipment), through a conduit or port 609, and into the internal space where said power means are housed, electrical connections may be made, and then both open faces closed and secured against theft and tampering; handhole 606 allows a user to pull wiring from elevated devices on pole component 300 before securing plates 603 with tamper-resistant screws 611.

3. Pole Components (FIG. 2G)

Pole component 300 includes a substantially hollow portion 301 which is inserted into substantially hollow pole receiving portion 605 (FIG. 2F), rested on or otherwise received by an internal ring 612, and leveled or otherwise plumbed to vertical with setscrews 608 (e.g., any model of passivated square-head cup-point set screw available from aforementioned McMaster-Carr); this is another example of the modularity of the system and how components are designed to work together to build up the soccer mini-pitch system. In practice, this leveling feature is useful to keep what is a relatively long pole (here, 24') on axis (here, vertical) so to ensure lighting from an elevated device such as a lighting fixture 302 strikes pitch 900 instead of nearby residences, for example. Lighting fixtures 302 may be of any design (non-limiting examples are described in U.S. Pat. No. 9,951,929 or U.S. patent application Ser. No. 15/826,772, (issued as U.S. Pat. No. 10,337,693 on Jul. 2, 2019), each of which is incorporated by reference herein in its entirety), may be adjustable via armature 303 (such as is described in U.S. Pat. No. 8,337,058 which is incorporated by reference herein in its entirety), and supplemented (i.e., via interface 306) with other devices such as speakers, sensors, crossarms with banners, cameras (such as is described in U.S. Pat. No. 9,363,441 incorporated by reference herein in its entirety), or the like; of course, pole component 300 could omit lighting fixtures 302 entirely, if desired. Like with other components already described, pole component 300 is shipped to the venue already prefabricated, pre-wired, and pre-aimed—or, mostly so and only requiring minimal onsite effort (e.g., connecting connector halves via pole cap 304 before lifting hollow pole portion 301 into place via jacking ear(s) 305); U.S. Pat. No. 10,199,712 incorporated by reference herein in its entirety discusses in greater detail factory aiming of different devices on a common pole, shipment to a venue, and reduced labor installation.

4. Seating Components (FIG. 2H)

Seating component 400 includes one or more bench-style anodized aluminum seats 406 which are on the order of 2"×12"×4' (e.g., model P21204AL available from Markstaar, Scarborough, Me., USA) and could be combined with end caps (e.g., model EC-*/WH also available from Markstaar) to prevent injury or for aesthetics if desired. Said seats 406 are clamped or otherwise mounted to legs 405 (which could be formed from the same 11 gauge, 2×2 A500 structural steel square tubing as is used for other components), legs 405 being welded to a frame 404 and feet 402. Portion 403 can be as long or as short as desired—and in the present embodiment is connected to structural component 107 because, as has been found, oftentimes spectators will climb on seats and so there is a benefit to improving the rigidity and ruggedness of seating by operatively connecting it to structural components of the mini-pitch system. Likewise, beverage holders 407 could be bolted or otherwise mounted onto stabilizing portion 401 (e.g. with aforementioned tamper-proof screws) or simply clamped (e.g., with any model of square u-bolt available from aforementioned McMaster-Carr), either option providing the same rigidity and rugged construction to withstand the weight of spectators climbing on them. Beverage holders 407 could be customized to hold any number of beverages, be of any size (e.g., sized for a large water bottle), or even include pegs 408** (e.g., for hanging lanyards, key rings, etc.) for temporary storage.

With further respect to seating component 400, bolts—if desired and which will differ depending on whether bolting to asphalt or concrete, as is later discussed—are bolted to a surface at both feet 402, as well as at stabilizing portion 401. Stabilizing portion 401—which includes the leveling functionality of leveling feet 700 (later discussed)—clamps or bolts or otherwise fastens around the aforementioned structural components (here, component 107, though this differs depending on seat position) to provide stability. Like other components described herein, each seating component 400 is shipped to the venue prefabricated and at least mostly assembled (e.g., seats 406 may be capped and clamped on site).

5. Goal Components (FIGS. 2I and 5J)

Goal component 800 generally includes a net material 807 (a coarser material like metal chain in FIG. 5J (e.g., any model of galvanized double loop chain available from Laclede Chain Manufacturing Company, LLC, St. Louis, Mo., USA) or a finer material like fabric, plastic, or other material mesh in FIG. 2I (e.g., any model of nylon barrier netting available from Cascade Nets, Ferndale, Wash., USA)) which could be positionally affixed using a variety of means (e.g., lashings, ties, rings), but according to the present invention is positionally affixed via s-hooks (e.g., any model available from aforementioned McMaster-Carr) crimped in place relative a formed portion of upper/lower and side portions 801 and 802, respectively, or via eyebolt (e.g., any model available from aforementioned McMaster-Carr) threaded directly into portions 801 and 802; it is of note that s-hooks and eyebolts are not illustrated in the Figures. Portions 801 and 802 could be formed from the same 11 gauge, 2×2 A500 structural steel square tubing as is used for other components, or otherwise. General dimensions for the present embodiment are listed in Table 2, but it is important to note that one or more of the 12 gauge galvanized steel plate portions of component 205 can be removed (as in this example they are bolted rather than welded) to effectively change the goal size; side steel plate portions 205 of FIGS. 2I and 5J measure approximately 7"×67" and the upper steel plate portion 205 measures approximately 18"×115".

TABLE 2

| Reference | Dimension (in) |
|---|---|
| X8 | 120 |
| X9 | 100 |
| Y3 | 93 |
| Y4 | 72 |
| Z1 | 36 |

A stabilizing portion 804 which interfaces with aforementioned structural components (see components 203, 204, and 205) could be said 11 gauge, 2×2 A500 structural steel square tubing, aforementioned 2" depth, 0.120" thick channel bar, or aforementioned angle iron (or otherwise).

6. Design and Installation

As has been stated, the soccer mini-pitch system is made up of a number of modular components which together form one or more sides; depending on a single pitch or double pitch venue, the number of sides may differ. Also, different sports or youth activities (e.g., street hockey, Ga-ga ball) may require a system with more or fewer sides with different components than a soccer mini-pitch. Regardless of the number of components, number of sides, or type of activity, the system approach to a common infrastructure to meet the many combinations of needs and restrictions for youth development programs is the same. One possible method of designing and installing such a system is illustrated in FIG. 3, and is presently discussed for the soccer mini-pitch system of the present embodiment.

A first step 4001 of method 4000 comprises evaluating existing neighborhood spaces for suitability, amenities, and the like; the complexity of this step will depend upon community needs and sport and level of play, for example, but likely considerations will include location, ability to fundraise, levelness of ground, available power, and the like. With respect to the present embodiment, some specific considerations may include: whether a flatbed truck or shipping container is more suitable, whether the venue is coastal and requires additional corrosion protection or is subject to high winds, what the ground is comprised of (e.g., asphalt versus concrete) and whether there is a ban on bolting to the ground, whether the system will require means to display advertisements (e.g., to supplement fundraising), whether the system (infrastructure and/or pitch) will need to be a particular color to blend into the neighborhood space, whether there is existing site power, whether there is existing lighting, and so on.

Using the wealth of information from step 4001 (which will likely include an onsite survey to evaluate the venue) one may begin to design the system according to step 4002. For example, knowing the size of the space from step 4001 informs the size of the overall system and general location of components during step 4002. For the present embodiment, knowing the field to be a 60'×120' single pitch allows one to first map out where each corner component will reside; the design of each corner (i.e., whether 300, 500, and/or 600) will be dictated by the information gathered in step 4001 (e.g., component 300 may be omitted if there is already adequate lighting at the venue). Once corners are mapped out, each side of the system can be built up; this is illustrated in FIGS. 4A-C for the present embodiment. As can be seen from FIGS. 4A and B, a side 100 might have multiple access points (note two gated doorways 106 in Detail A of FIG. 2B) or only one (note one gated doorway 106 in Detail B of FIG. 2C) and any number of seating components 400; again, components can be mixed and matched as they are all designed to work together (e.g., sit flush together with common interfaces (e.g., threaded apertures) for fastening devices such that each component may be placed end-to-end, end-to-corner, or corner-to-corner with another component). As can be seen from FIG. 4C, a side 200 may have a goal component 800 that is sized for the needs of the community; perhaps even different sized goals on either end of the pitch so to accommodate half-field games for different age groups. Again, the modular nature of the system allows a user to build up a customized system based on community needs (as determined in step 4001). Another important aspect of step 4002 is determining how many and where to place leveling feet 700; leveling feet 700 (FIG. 4E) are important to the system because (i) the ground and/or playing surfaces in many neighborhood spaces are not level, and (ii) it provides means for pitch maintenance (e.g., by allowing debris to be swept, blown, or washed away). Whether or not leveling feet can be bolted to the ground, the overall weight and weight distribution of the system, and areas of the system with higher exposure to wind loads (e.g., pole component 300) are some of the considerations that go into determining the number and location of leveling feet 700; FIGS. 4A-C illustrate possible locations for the specific example of FIG. 2A.

According to step 4003 components are selected from a prefabricated inventory to fulfill the design developed in step 4002. An important aspect of step 4003 is not only identifying the type and number of components (e.g., how many of component 101 to pull from inventory, how many of component 102, etc.), but also identifying the type and number of fasteners and discrete units/devices within a component. With respect to the former, each component is intended to be modular; therefore, each component is bolted (as opposed to welded) to another component in the system of this embodiment. FIG. 4D illustrates via arrows just a few of the many points between (and even within) components which are bolted with, for the present embodiment, ½"-13×2" 316 stainless steel hex bolts (available from ITW Brands, Glenview, Ill., USA) so to place the various components in operative connection. The number of bolts (dozens and perhaps hundreds) must be determined and verified, and gathered from inventory according to step 4003. This is likewise true of bolts used to anchor the system to the ground (assuming such is possible according to step 4001). According to step 4003, the type of anchoring bolt used in leveling feet 700, feet 402, and stabilizing portion 401 must first be determined, and then quantity determined and gathered from inventory. For the present embodiment, ½"×5½" wedge anchors (e.g., part WA12512 available from Concrete Fasteners, Inc., Cleveland, Ohio, USA) can be used for concrete; ⅞"×12" anchors with grout (e.g., model SP18 and EPX2, respectively, available from Asphalt Anchors Corporation, West Orange, N.J., USA) can be used for asphalt.

With respect to the latter aspect of step 4003 (identifying number and type of devices), this includes more than simply identifying that a pole component 300 designed according to step 4002 includes both a lighting fixture 302 and a camera 307 (see again FIG. 4D), for example. Step 4003 may include not only pulling lighting fixture 302 from a prefabricated inventory, but also determining height of pole 301 so to measure out power lines, determining the correct power and size for a generator to fit in component 600 (assuming site power is not available), etc.

According to step 4004 all the various parts of the system are packaged and shipped to the venue in accordance with the shipping method identified in step 4001. Again, all components are designed to be of a size (e.g., see again Tables 1 and 2) to be transported using a standard flatbed truck or standard shipping container regardless of field size; specifically, as envisioned the largest component in length is approximately 18' (though poles intended for lighting fixtures can reach 24'), the tallest component in height is approximately 8', and the largest field size is 60'×120' which has a total component weight of no more than 10,000 pounds (all of which is well below the maximum of such conventional standard trucks—see again incorporated by reference U.S. Pat. No. 6,692,142). Once delivered, components may be assembled according to step 4005 so to build up the common infrastructure. It is also at this step that the components are interfaced with any existing features or amenities; for example, if goals are already present at the venue, structural components previously described would be bolted to said pre-existing goals so to form an end side such as that illustrated in FIGS. 4C and D.

Also an important aspect of step 4005 is the leveling of the infrastructure via leveling feet 700 and stabilizing portion 401. As can be seen in FIG. 4E for leveling feet 700, structural portion 703 is bolted to the ground using either of the aforementioned anchors 702 (depending on whether the ground is concrete or asphalt), the various components described herein are seated in the u-shaped portion of structural portion 703 (see, for example, FIGS. 2E and F), and a combination of threaded bolt 701 (e.g., 1, ½"-13×1.5" 316 stainless steel hex bolts available from aforementioned ITW Brands) and nut 704 (e.g., 1, ½"-13 hex nut available from aforementioned ITW Brands) are selectively positioned such that a portion of bolt 701 extends into the u-shaped space (as indicated by the double arrow in FIG. 4E), thereby selectively raising or lowering the structural component seated in the u-shaped space (i.e., in direct contact with bolt 701), and nut 704 secures the selected position. The leveling process for stabilizing portion 401 is the same, but the construction is slightly different insomuch that stabilizing portion 401 not only acts as leveling feet, but also acts as an interface for beverage holders 407 and seat 406 (via portion 403—see FIG. 2H).

After the infrastructure has been installed and leveled, onsite assembly of devices can occur according to step 4006. As previously described, pole component 300 may include sensors, cameras, lighting fixtures, speakers, generators, or the like—according to step 4006 any of these devices may need to be mounted or partially assembled, or even snapped into operational orientation following factory aiming (see again incorporated by reference U.S. Pat. No. 10,199,712). Said devices may require commissioning after being powered (step 4007). As was previously discussed, devices at or near the top of a substantially hollow pole portion 301 may have wiring that needs to be pulled down the interior of pole portion 301, said wire routed into a different unit to be powered (e.g., via generator), and the unit containing both the pole portion and power means secured against tampering—but this only serves to power devices. Even after powering it is common for devices to need to be connected to a local area network, or a product key entered to ensure full functionality, or users set up on a portal which remotely accesses devices—all are included in step 4007.

After all the aforementioned is complete, the pitch (i.e., the playing surface) can be laid according to step 4008. While this could vary, in practice laying the pitch last ensures that it is not damaged during other steps in installation. Non-limiting examples of the playing surface could be sheets of turf mat with artificial grass attached thereto which are rolled out and positioned, or a composite material similar to what is used in other youth activities (e.g., compressed recycled rubber-like material) that is of a custom size, or the ground itself coated (e.g., with an acrylic-based material), for example. It is important to note that often the underlying ground is not at all level, and so often the playing surface laid thereupon is also not level; this can be accounted for and corrected by leveling feet 700, as well as setscrews 608 (e.g., to keep lighting fixtures plumb), and is another example of how components are designed to work together to build up the soccer mini-pitch system as envisioned.

C. Options and Alternatives

The invention may take many forms and embodiments. The foregoing examples are but a few of those. To give some sense of some options and alternatives, a few examples are given below.

At the system level, there are many options and alternatives which are possible according to aspects of the present invention. For example, the methodology as described herein could contain more, fewer, or different steps so to design and install a system other than what has been illustrated herein. A venue may have originally opted for a bolted solution but then opt to move the system, and so step 4003 may include sourcing an epoxy which can fill existing bolt holes when the system is moved. Timing may be such that the pitch (step 4008) must be installed first. The sport could differ, field markings could differ, field sizes could differ (see, e.g., FIGS. 5A-I), and the like such as the number, size, and configuration of sides 100 and 200. Evaluation of the venue (step 4001) may reveal that the best power option is solar—and so step 4002 may need to be modified to include design of a solar panel such as that illustrated in FIG. 7 which forms a part of the system but is not part of the common infrastructure. An additional step of method 4000 may be needed to determine power requirements for lighting and other devices—whether simple on/off control is needed, or remote scheduled control (such as is described in U.S. Pat. No. 7,209,958 incorporated by reference herein in its entirety), for example. All of the aforementioned are possible, and envisioned.

At the side level, additional options and alternatives are possible, and envisioned. Sides may not resemble sides as much as approximate a curve for activities such as Ga-ga ball. Sides may include more or fewer than those illustrated herein; see FIGS. 6A-C which illustrate one possible double pitch solution 3000; here there are effectively six sides because of a double-walled center created by spaced-apart components 902 formed from the same 11 gauge, 2×2 A500 structural steel square tubing as is used in other components at a length of 20" so to create an overall spacing between the two center sides on the order of 24". FIGS. 6A-C also illustrate that sides may include different types or quantities of components to achieve a desired size or shape; see, for example, component 901 of FIG. 6B which is a structural component measuring 24"×93" designed to stabilize the double-walled center when seated in an alternative design of leveling feet 700 (see also FIG. 5L). Components 903 and 904 are formed from the same 11 gauge, 2×2 A500 structural steel square tubing and/or 2" depth, 0.120" thick channel bar (or in some cases angle iron) as is used in other components at a length of 33" and 36", respectively, and are the only other components needed to produce a double pitch solution; namely, as can be seen from FIG. 6B (which shows newly introduced components in broken line) a very small number of components can be introduced into the mini-pitch system to effectively double the number of fields in a given space.

Further, at the component level additional options and alternatives are possible, and envisioned. Material types, finishes, colors, and processing could differ—even between components; see, for example, the alternative goal material 807 of FIG. 5J. The number and type of devices (if any) associated with a component could differ. Components could differ from those illustrated herein; see FIG. 5K which illustrates sides 100 and 200 having structural components with vertically running bars with a 5" air gap therebetween rather than diagonally running bars, or see again FIG. 5L which illustrates an alternative design of leveling feet 700. Components could be processed for aesthetics (e.g., painted to match a team color), for resistance to wear and tear, or for improved corrosion resistance (e.g., hot-dip galvanized), for example. Also, additional components are possible. For example, as was previously stated, it is possible a neighborhood space may require a solar power solution. In this example a new power component 5000 (FIG. 7) includes a frame 5002 which together with supports 5003 and 5006 may house one or more solar cells 5001 (e.g., any of the AXIpremium models available from Axitec Solar USA, Delran, N.J., USA) which are elevated via a pole 5008 and angled (e.g., by support 5006 via bracket 5007 and by pivot bar 5004 via pivot bar support 5005) so to face a particular direction at a particular angle (e.g., true South at 55 degrees upward from vertical) when secured in a base 5009 (such as is described in U.S. Pat. No. 5,944,413 incorporated by reference herein in its entirety). Generated electricity may be transferred via power line 5010 and stored (here in the form of battery storage 5011), and used to power devices on e.g., pole component 300, via power line 5012—which could be run underground or even routed along and secured to structural components of the system.

Finally, it should be noted that the design and overall aesthetic of the mini-pitch system could differ from what is illustrated herein and not depart from aspects according to the present invention. For example, corner components 500 and 600 are purposefully built outwardly from what would otherwise be a rectangular top view; not only does this aid in stability, but it provides surfaces for advertisements or adornments (e.g., team colors)—but the invention is not limited to such (e.g., corner components could be rounded or be slimmer to retain more of a rectangular top view). Further, structural component 102 is designed as spaced-apart bars to (i) reduce weight, (ii) reduce cost, and (iii) allow spectators not on seating to still be able to see the game in play—but the invention is not limited to such (e.g., component 102 could be solid material). The design and overall aesthetic could even include additional features; scoreboards or video boards could be included in pole component 300, interchangeable signage or graffiti art (e.g., with positive messages that generally support the mission of the youth development program) could be included on nearly any component, etc. All of the aforementioned are possible, and envisioned.

What is claimed is:

1. A customizable portable system for creating a field-based sport venue and one or more playing fields each having a perimeter comprising:

a. a plurality of portable, prefabricated, modular structural components which when assembled approximates the perimeter of the one or more playing fields, said plurality of portable, prefabricated, modular structural components comprising:

i. one or more components designed to withstand a specified wind load and provide rigidity; and ii. one or more gates to allow access to the one or more playing fields;

b. one or more seating components in operative connection with the plurality of perimeter structural components;

c. a stabilizing portion connected to, extending outward of, and enveloping one or more of the perimeter structural components and comprising a tubular frame with an open infrastructure defining an open space;

d. a quantity and spacing of adjustable leveling feet to level at least one of the perimeter structural components and seating components to compensate for a levelness of the one or more playing fields and allow the perimeter structural components to float above the level of the one or more playing fields; and e. a plurality of fasteners for operatively connecting the perimeter structural components.

2. The customizable portable system of claim 1 further comprising one or more prefabricated, accessible, enclosed storage components in operative connection with the stabilizing portion.

3. The customizable portable system of claim 1 further comprising an artificial pitch within the perimeter of the plurality of structural components.

4. The customizable portable system of claim 1 wherein the plurality of portable, prefabricated, modular structural components further comprises one or more components designed to keep a ball or object on the one or more playing fields.

5. The customizable portable system of claim 1 further comprising a plurality of temporary storage devices on one or more of the plurality of portable, prefabricated, modular structural components or one or more of the seating components, wherein the plurality of temporary storage devices comprise pegs.

6. The system of claim 5 wherein at least one of the one or more seating components further comprises one or more of:

a. one or more beverage holders; and b. one or more temporary storage pegs.

7. The customizable portable system of claim 1 wherein the one or more adjustable leveling feet comprise:

a. an adjustable portion in direct contact with said one or more perimeter structural components designed to withstand a specified wind load and provide rigidity and adapted to adjust the height of said one or more perimeter structural components; and b. a portion adapted to anchor the leveling feet to a ground surface.

8. The system of claim 1 wherein the plurality of portable, prefabricated, modular structural components further comprises one or more goal frames in operative connection to other of the plurality of structural components.

9. The system of claim 1 further comprising one or more pole components in operative connection with the plurality of portable, prefabricated, modular structural components.

10. The system of claim 9 further comprising a receiving portion mounted in interior space of the stabilizing portion, the receiving portion adapted to receive and support one of the one or more of said pole components.

11. The system of claim 9 further comprising one or more lighting fixtures elevated on at least one of the one or more pole components.

12. The system of claim 9 further comprising one or more electrically powered devices mounted on at least one of the one or more pole components.

13. The system of claim 12 wherein the one or more electrically powered devices comprise one or more of:

a. lighting fixtures;
b. sensors;
c. speakers;
d. camera;
e. banners;
f. scoreboards; and video boards.

14. The system of claim 1 wherein the plurality of portable, prefabricated, modular structural components comprise:

a. a subset comprising opposite sides of the perimeter;
b. a subset comprising opposite ends of the perimeter; and
c. a subset comprising corners at junctions between sides and ends of the perimeter.

15. The system of claim 14 wherein the stabilizing portion is at one or more of:

a. a corner of the perimeter;
b. along a side of the perimeter, and
c. along opposite sides of the perimeter.

16. The system of claim 14 wherein the plurality of portable, prefabricated, modular structural components further comprises:

d. a subset between the opposite sides of the perimeter to create a double pitch playing field.

* * * * *